US010793384B2

(12) United States Patent
Nagafuchi et al.

(10) Patent No.: US 10,793,384 B2
(45) Date of Patent: Oct. 6, 2020

(54) ROLL TRANSFER DEVICE AND ROLL TRANSFER METHOD

(71) Applicant: ZUIKO CORPORATION, Osaka (JP)

(72) Inventors: Shinichiro Nagafuchi, Osaka (JP); Hitoshi Sato, Osaka (JP); Yoshiaki Tsujimoto, Osaka (JP)

(73) Assignee: ZUIKO CORPORATION, Osaka (JP)

( * ) Notice: Subject to any disclaimer, the term of this patent is extended or adjusted under 35 U.S.C. 154(b) by 39 days.

(21) Appl. No.: 16/309,644

(22) PCT Filed: Jun. 9, 2017

(86) PCT No.: PCT/JP2017/021480
§ 371 (c)(1),
(2) Date: Dec. 13, 2018

(87) PCT Pub. No.: WO2017/221747
PCT Pub. Date: Dec. 28, 2017

(65) Prior Publication Data

US 2019/0315587 A1 Oct. 17, 2019

(30) Foreign Application Priority Data

Jun. 22, 2016 (JP) ..... 2016-123429

(51) Int. Cl.
*B65H 19/12* (2006.01)
*B65H 16/02* (2006.01)

(52) U.S. Cl.
CPC ..... *B65H 19/12* (2013.01); *B65H 16/021* (2013.01); *B65H 2701/1924* (2013.01)

(58) Field of Classification Search
CPC .. B65H 19/12; B65H 16/021; B65H 2513/41; B65H 2220/04
See application file for complete search history.

(56) References Cited

U.S. PATENT DOCUMENTS 4,773,609 A 9/1988 Steffen et al.
4,863,112 A * 9/1989 Summerauer ..... B21C 47/245 242/422.6

(Continued)

FOREIGN PATENT DOCUMENTS

CN 1129665 8/1996
CN 1178454 4/1998

(Continued)

OTHER PUBLICATIONS

International Search Report dated Aug. 29, 2017 in International (PCT) Application No. PCT/JP2017/021480.

(Continued)

*Primary Examiner* — Sang K Kim
(74) *Attorney, Agent, or Firm* — Wenderoth, Lind & Ponack, L.L.P.

(57) ABSTRACT

A roll conveyance device includes a transportation device including a roll holding shaft extending in a predetermined direction from a distal section of an arm to hold a roll such that the roll holding shaft is inserted into a core member of the roll; and a mounting section within a moving range of the roll holding shaft, the mounting section allowing the roll to be mounted in a state in which both axial ends of the core member of roll are open. The transportation device is configured to mount the roll on the mounting section, the roll holding shaft is to be pulled out from the core member of the roll mounted on the mounting section to a first side of an axial direction of the core member, and the roll holding shaft is to be inserted into the core member from a second side of the axial direction.

8 Claims, 20 Drawing Sheets

(56) References Cited

U.S. PATENT DOCUMENTS

| | | | | |
|---|---|---|---|---|
| 5,685,685 | A | 11/1997 | Beckmann | |
| 6,276,628 | B1 * | 8/2001 | Focke | B21C 47/242 242/559.1 |
| 6,553,746 | B1 * | 4/2003 | Cere' | B65B 11/025 53/389.1 |
| 2002/0092945 | A1 * | 7/2002 | Resta | B65H 19/12 242/419.4 |
| 2011/0280701 | A1 | 11/2011 | Brighenti et al. | |
| 2015/0251868 | A1 | 9/2015 | Brighenti et al. | |
| 2016/0060059 | A1 | 3/2016 | Macura et al. | |
| 2016/0130088 | A1 * | 5/2016 | English | B21C 47/242 414/779 |
| 2017/0137247 | A1 | 5/2017 | Sato et al. | |
| 2017/0137248 | A1 * | 5/2017 | Sato | B65H 19/18 |
| 2017/0137251 | A1 * | 5/2017 | Sato | B65H 20/16 |
| 2017/0233206 | A1 * | 8/2017 | Wimmer | B65H 19/12 242/554 |
| 2017/0247214 | A1 * | 8/2017 | Wimmer | B65H 19/12 |
| 2018/0141772 | A1 * | 5/2018 | Prankl | B65H 19/12 |

FOREIGN PATENT DOCUMENTS

| | | |
|---|---|---|
| CN | 1982182 | 6/2010 |
| CN | 102448858 | 5/2012 |
| CN | 103879813 | 6/2014 |
| CN | 106144711 | 11/2016 |
| EP | 0 245 187 | 11/1987 |
| EP | 1 798 174 | 6/2007 |
| JP | 2-291341 | 12/1990 |
| JP | 8-207914 | 8/1996 |
| JP | 9-323847 | 12/1997 |
| WO | 2016/002531 | 1/2016 |
| WO | 2016/173854 | 11/2016 |
| WO | 2018/192808 | 10/2018 |

OTHER PUBLICATIONS

Office Action dated Nov. 27, 2019 in corresponding Chinese Patent Application No. 2017800384662, with English Translation.

Extended European Search Report dated Mar. 11, 2020 in European Application No. 17815216.1.

* cited by examiner

ROLL TRANSFER DEVICE AND ROLL TRANSFER METHOD

TECHNICAL FIELD

The present invention relates to a roll conveyance device and a roll conveyance method for conveying a roll including a tubular core member and a sheet wound around a periphery of the core member from a mounting position set in advance to a target position.

BACKGROUND ART

Conventionally, when various types of processing are performed on a sheet, the sheet is continuously fed from a roll formed by winding the sheet around a periphery of a core member, and is supplied to a processing device or the like.

For example, a disposable diaper is formed of a plurality of sheets with different materials and width, such as a nonwoven fabric, a film, and a tissue. When this diaper is manufactured, each sheet is continuously fed from a plurality of types of rolls formed of various sheets, and various types of processing are performed.

As a system for continuously feeding the sheet in this way, WO 2016/002531 discloses a sheet feeding device including: a supporting shaft inserted into a central portion of a roll around which the sheet is wound from one side of an axial direction of the roll, the supporting shaft supporting the roll; a motor that drives this supporting shaft to rotate to send out the sheet; and a plurality of guide sections that guides the sent sheet.

In the system that processes the roll-shaped sheet described above, in order to further enhance work efficiency, it is preferred that the roll be automatically carried into a target position of the feeding device or the like.

In contrast, it can be considered to include a holder that is inserted into the central portion of the roll from one side of the axial direction of the roll to hold the roll, to provide a device that can move the holder, and to move the holder and furthermore the roll to convey the roll to the target position automatically.

However, it may have been determined in advance in what posture to dispose the roll at the target position. For example, when the sheet is continuously fed from the roll at the target position, it is necessary to convey the roll to the target position in a posture in which a winding direction of the roll is a direction in which the sheet is continuously feedable. Therefore, with a device that simply conveys the roll to the target position, it is necessary to perform, before conveyance of the roll, work for causing the roll to have a posture in which the winding direction of the roll is the direction required at the target position, and work efficiency cannot be sufficiently enhanced.

SUMMARY OF INVENTION

The present invention has been made to solve the above-described problem, and an object of the invention is to provide a roll conveyance device that can convey the roll to the target position in a state where the winding direction of the roll is an appropriate direction while enhancing work efficiency, and a roll conveyance method using the roll conveyance device.

The present invention provides a roll conveyance device for conveying a roll including a tubular core member and a sheet wound around a periphery of the core member from a mounting position set in advance to a target position. The roll conveyance device includes: a transportation device including: a body; an arm including a proximal section connected to the body and a distal section that is relatively displaceable with respect to the proximal section; and a roll holding shaft, the roll holding shaft holding the roll in a state of extending in a predetermined direction from the distal section of the arm and being inserted into the core member of the roll; a controller configured to control the transportation device in such a manner that the roll holding shaft moves from the mounting position to the target position; and a re-hold mounting section disposed within a moving range of the roll holding shaft, the re-hold mounting section having a shape that allows the roll to be mounted in a state where both ends of an axial direction of the core member of the roll are open in order to change an insertion direction of the roll holding shaft into the core member of the roll. The controller controls the transportation device in such a manner that the roll with the roll holding shaft inserted is mounted on the re-hold mounting section, the roll holding shaft is pulled out from the core member of the roll mounted on the re-hold mounting section to one side of the axial direction of the core member, and the roll holding shaft pulled out from the core member is inserted into the core member of the roll from the other side of the axial direction of the core member to hold the roll.

Also, the present invention provides a roll conveyance method for conveying a roll including a tubular core member and a sheet wound around a periphery of the core member from a mounting position set in advance to a target position, by using: a transportation device including: a body; an arm including a proximal section connected to the body and a distal section that is relatively displaceable with respect to the proximal section; and a roll holding shaft, the roll holding shaft holding the roll in a state of extending in a predetermined direction from the distal section of the arm and being inserted into the core member of the roll; and a re-hold mounting section having a shape that allows the roll to be mounted in a state where both ends of an axial direction of the core member of the roll are open in order to change an insertion direction of the roll holding shaft into the core member of the roll. The roll conveyance method includes a roll re-holding step to be performed while conveying the roll from the mounting position to the target position. The roll re-holding step includes: a roll mounting step of mounting the roll on the re-hold mounting section; a pull out step of pulling out the roll holding shaft from the core member of the roll mounted on the re-hold mounting section to one side of the axial direction of the core member; and a re-roll holding step of inserting the roll holding shaft pulled out from the core member into the core member of the roll from the other side of the axial direction of the core member to cause the roll holding shaft to hold the roll.

The present invention can convey the roll to the target position in a state where the winding direction of the roll is an appropriate direction while enhancing work efficiency.

DESCRIPTION OF EMBODIMENT

An embodiment of the present invention will be described below with reference to the accompanying drawings. Note that the following embodiment is an example of embodying the present invention, and does not limit the technical scope of the present invention.

(1) OVERALL SYSTEM CONFIGURATION

Figure 1:
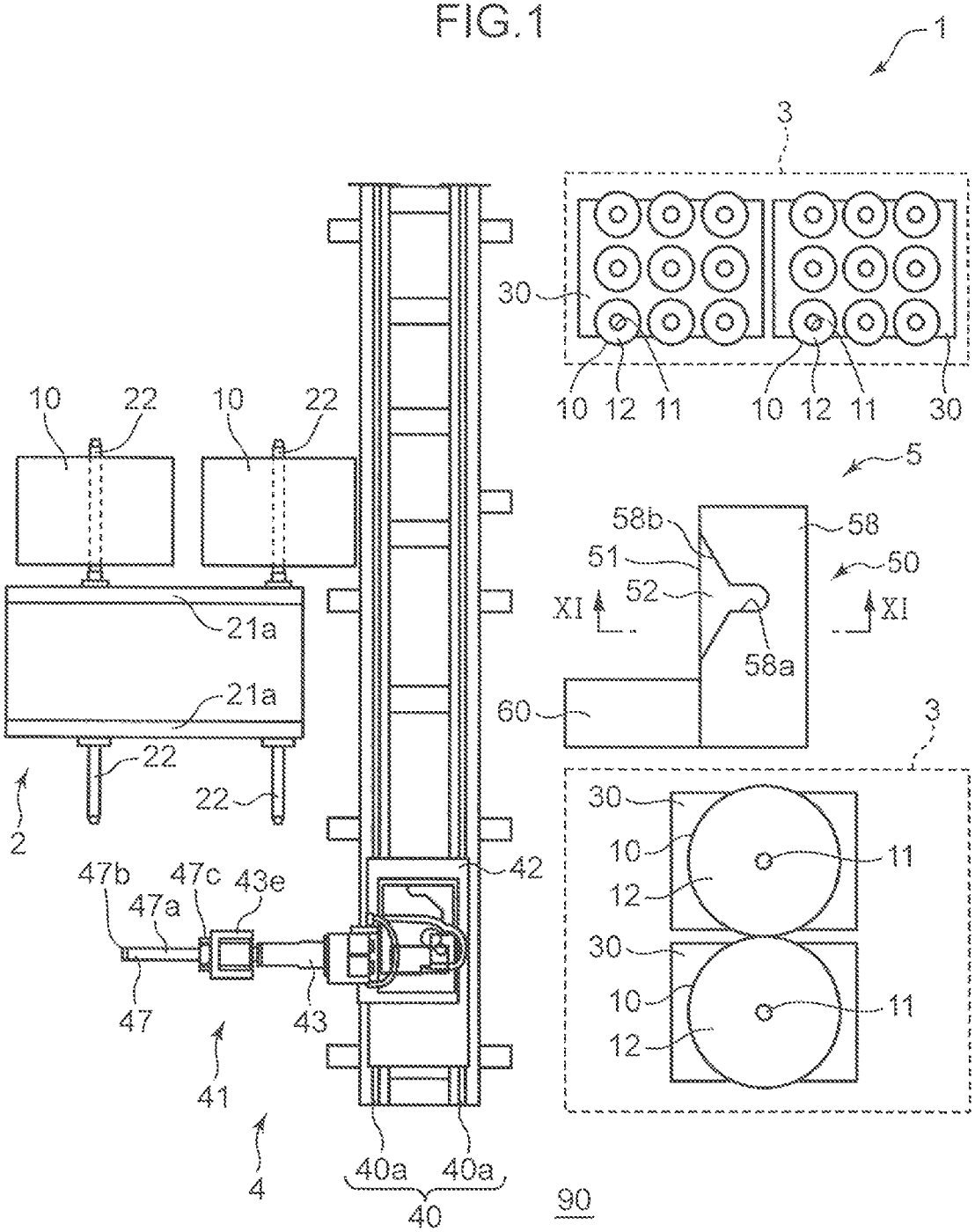
FIG. 1 is a plan view schematically showing an overall configuration of a sheet supply system 1 according to the present embodiment.
Figure 2:
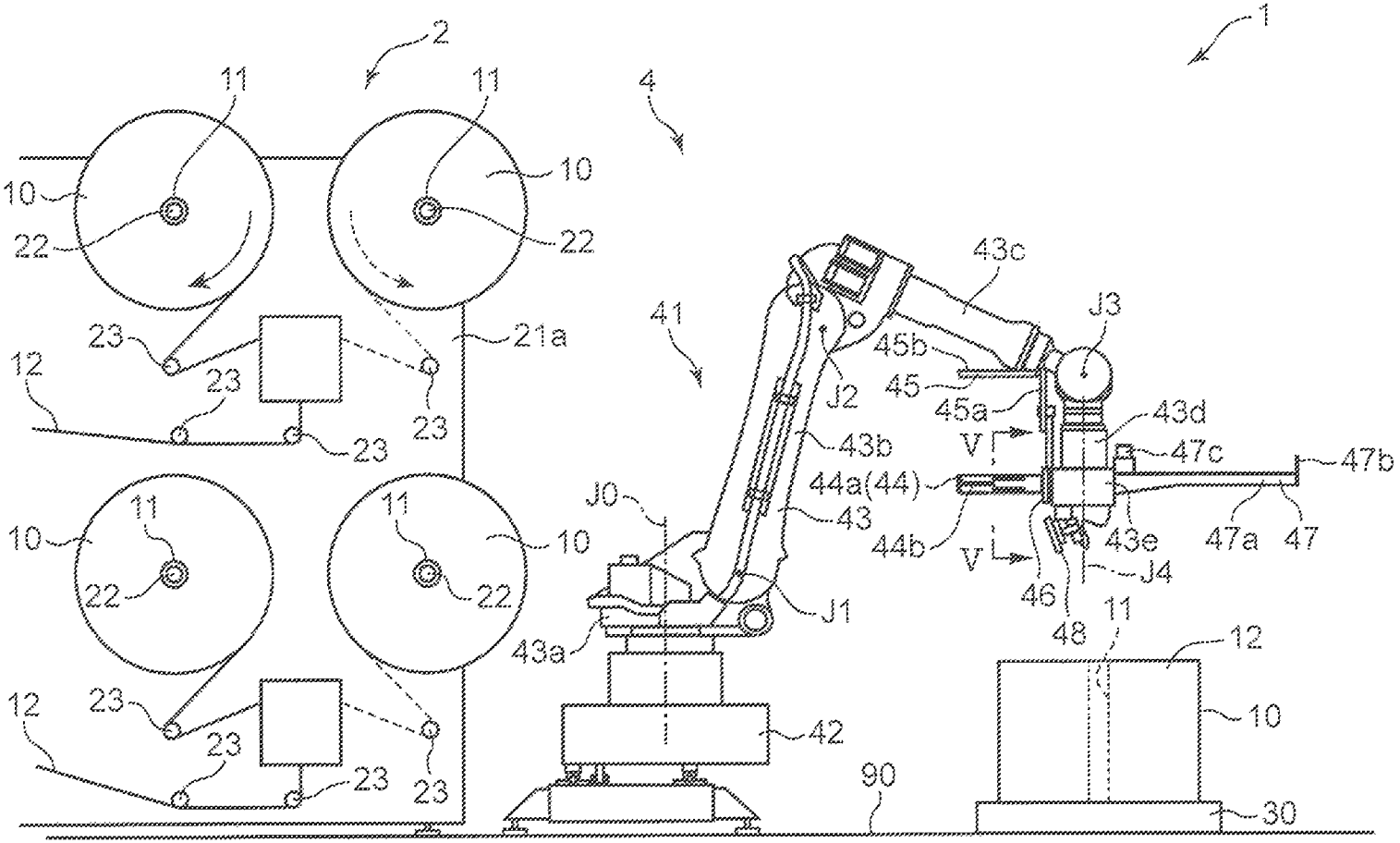
FIG. 2 is a side view schematically showing the overall configuration of the sheet supply system 1.

FIG. 1 is a plan view schematically showing an overall configuration of a sheet supply system 1 according to the present embodiment. FIG. 2 is a side view schematically showing the overall configuration of the sheet supply system 1.

The sheet supply system 1 is a system for supplying a sheet 12 from a roll 10 including a tubular core member 11 and the sheet 12 wound around a periphery of the core member 11.

The sheet supply system 1 includes a sheet supply device (target position) 2, a roll mounting section (mounting position) 3, and a roll conveyance device 200. The roll conveyance device 200 includes a transportation device 4, an intermediate processing device 5, and a controller 100 (controller, refer to FIG. 19).

In the present embodiment, the sheet supply system 1 is used in a manufacturing system for manufacturing disposable diapers. This manufacturing system performs various types of processing on the sheet 12 supplied from the sheet supply system 1 to manufacture disposable diapers.

(2) DETAILED STRUCTURE OF DEVICES

Details of each device will be described. Hereinafter, a direction along a rail 40 to be described later of the transportation device 4, that is, a vertical direction of FIG. 1 is referred to as a front and rear direction, and up and down of FIG. 1 are referred to as front and rear, respectively. In addition, a right and left direction of FIG. 1 is simply referred to as a right and left direction, and right and left of FIG. 1 are simply referred to as right and left, respectively.

(2-1) Sheet Supply Device

The sheet supply device 2 includes one pair of supporting walls 21*a* and 21*a*, a plurality of pairs of supporting shafts (roll supporters) 22, and a plurality of guide rolls 23.

Each of the supporting walls 21*a* extends upward from a floor 90 and extends in the right and left direction, and stands side by side in parallel with each other along the front and rear direction.

Each of the supporting shafts 22 is a member for supporting the roll 10. Each supporting shaft 22 has a generally cylindrical shape and supports the roll 10 by being inserted into the core member 11 of the roll 10. Each supporting shaft 22 extends in a horizontal direction from the supporting walls 21*a* and 21*a*. In the example shown in FIG. 1 and FIG. 2, the back side supporting wall 21*a* is provided with four (two pairs of) supporting shafts 22 extending backward from the supporting wall 21*a*, and the front side supporting wall 21*a* is provided with four (two pairs of) supporting shafts 22 extending forward from the supporting wall 21*a*. In addition, each of an upper portion and a lower portion of each supporting wall 21*a* is provided with two (one pair of) supporting shafts 22 side by side on the right and left.

Each of the guide rolls 23 is for guiding the sheet 12 along a predetermined path. Each guide roll 23 also extends in the horizontal direction from the supporting walls 21*a* and 21*a*.

The sheet 12 of the roll 10 supported by the supporting shaft 22 is fed from the roll 10 as a motor drives the supporting shaft 22 to rotate. This sheet 12 is conveyed along the path via each guide roll 23 by being received by a device of a downstream step (not shown).

Here, a rotation direction of the roll 10 when the sheet 12 is fed from the roll 10 supported by the supporting shaft 22 is determined in advance for each supporting shaft 22. Each guide roll 23 is disposed such that the sheet 12 is appropriately fed to the downstream step along the path only by the roll 10 rotating in this determined rotation direction.

In the example shown in FIG. 2, when the roll 10 supported by the supporting shaft 22 provided on the left side rotates clockwise viewed from a tip side of the supporting shaft 22 as shown in a solid line arrow, the sheet 12 is fed appropriately from the roll 10. Meanwhile, in the roll 10 supported by the supporting shaft 22 provided on the right side, when the roll 10 rotates counterclockwise viewed from the tip side of the supporting shaft 22 as shown in a broken line arrow, the sheet 12 is fed appropriately from the roll 10.

Here, the disposable diaper is formed of a plurality of types of sheets with different materials and width, such as a nonwoven fabric, a film, and a tissue. Correspondingly, the sheet supply device 2 can feed each sheet continuously from a plurality of types of rolls with different materials, width, and outside diameters. That is, each pair of supporting shafts 22 different from each other of the sheet supply device 2 supports the rolls 10 with the types different from each other as necessary, and the plurality of types of sheets different from each other is fed from the rolls 10 toward the downstream step. However, inside diameters of the core members 11 of the rolls 10 are almost the same, and outside diameters of all the supporting shafts 22 of the sheet supply device 2 are set almost the same.

(2-2) Roll Mounting Section

The roll mounting section 3 is a section on which the roll 10 before use is mounted. In the present embodiment, part of the floor 90 functions as the roll mounting section 3. In the example shown in FIG. 1, on an opposite side (right side) of the rail 40 from the sheet supply device 2, one roll mounting section 3 is provided in each of front and rear of the intermediate processing device 5. In the example shown in FIG. 1, the roll 10 with a small outside diameter is mounted on the front-side roll mounting section 3, and the roll 10 with a large outside diameter is mounted on the rear-side roll mounting section 3.

As shown in FIG. 1 and FIG. 2, the rolls 10 are mounted on the roll mounting section 3 in a posture in which an axis of the core member 11 extends in the vertical direction. In the present embodiment, one or more rolls 10 are carried into the roll mounting section 3 in a state of being placed on a pallet 30. Also, the rolls 10 are mounted on the roll mounting section 3 in the state of being placed on the pallet 30.

(2-3) Transportation Device

As described above, the transportation device 4 includes the rail 40 that is positioned between the sheet supply device 2 and the roll mounting section 3 and extends in the front and rear direction, and an operation robot 41 moving on the rail 40. The rail 40 includes a pair of rail members 40*a* and 40*a* aligned in parallel.

The operation robot 41 includes a running section (body) 42 sliding on the rail 40 and an arm 43 coupled with the running section 42.

The running section 42 includes a built-in running motor 201 (refer to FIG. 19, and hereinafter referred to as a running motor). The running section 42, and thus the operation robot 41 is driven by the running motor 201 to move on the rail 40.

The arm 43 is a multi-jointed arm. The arm 43 includes a proximal section 43*a* connected to the running section 42, and a head (distal section) 43*e* that is relatively displaceable with respect to the proximal section 43*a*.

Specifically, as shown in FIG. 2, the proximal section 43*a* is connected to the running section 42 pivotably about a pivot axis J0 extending in the vertical direction. The arm 43 includes a first arm 43*b* connected to the proximal section 43*a* pivotably about a first axis J1 extending in the horizontal direction, a second arm 43*c* connected to the first arm 43*b* pivotably about a second axis J2 extending in the horizontal direction, and a third arm 43*d* connected to the second arm 43*c* pivotably about a third axis J3 extending in the horizontal direction. Then, the head 43*e* is connected to the third arm 43*d* pivotably about a fourth axis J4 extending in a direction orthogonal to the third axis J3.

The proximal section 43*a*, the arms 43*b*, 43*c*, and 43*d*, and the head 43*e* are driven by a plurality of motors provided in the operation robot 41, and turn or pivot about the axes J0 to J4, respectively. Hereinafter, the motors driving the proximal section 43*a*, the arms 43*b*, 43*c*, and 43*d*, and the head 43*e* are together referred to as arm driving motors 202 (refer to FIG. 19).

Components such as a transportation-side holder 44, a pressure section 45, a pusher (extruding unit) 46, a core member detachment section 47, and a head-side camera 48 are movably attached to the head 43*e* integrally with the head 43*e*.

(i) Transportation-Side Holder

Figure 3:
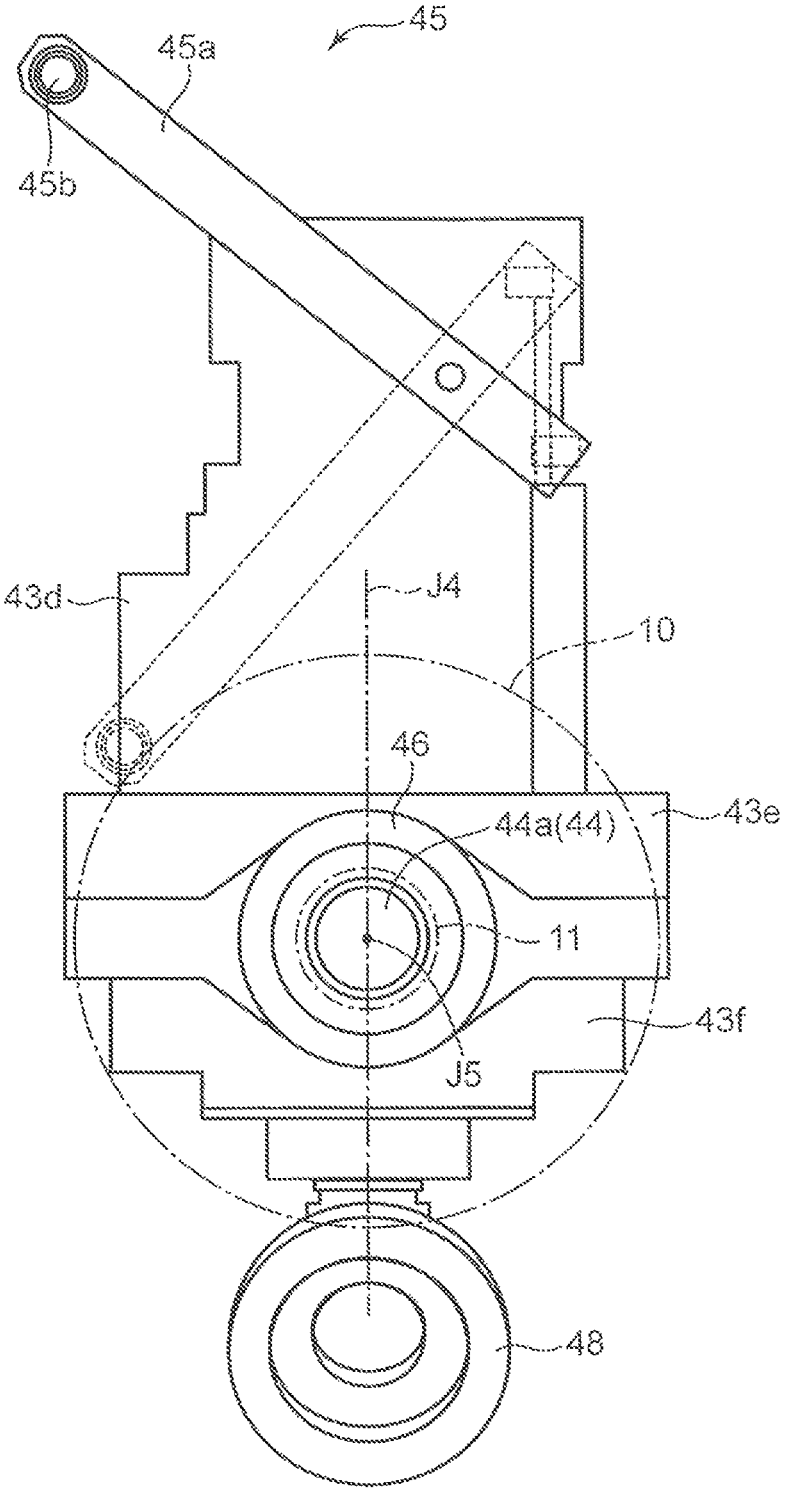
FIG. 3 is a schematic side view of a head viewed from one side of a direction orthogonal to a fourth axis.
Figure 4:
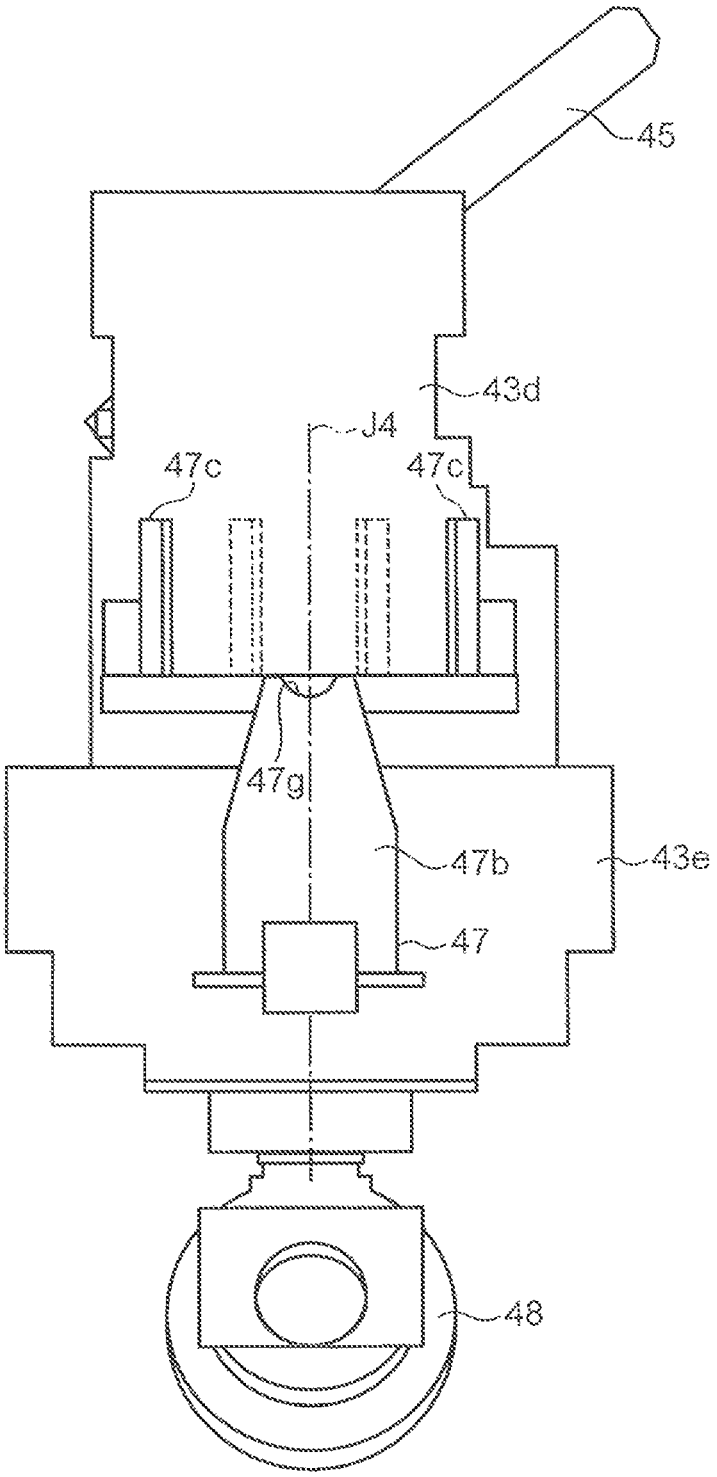
FIG. 4 is a schematic side view of the head viewed from the other side of the direction orthogonal to the fourth axis.

FIG. 3 and FIG. 4 are schematic side views of the head 43*e* viewed from both sides of a direction orthogonal to the fourth axis J4.

The transportation-side holder 44 is for holding the roll 10.

Figure 5:
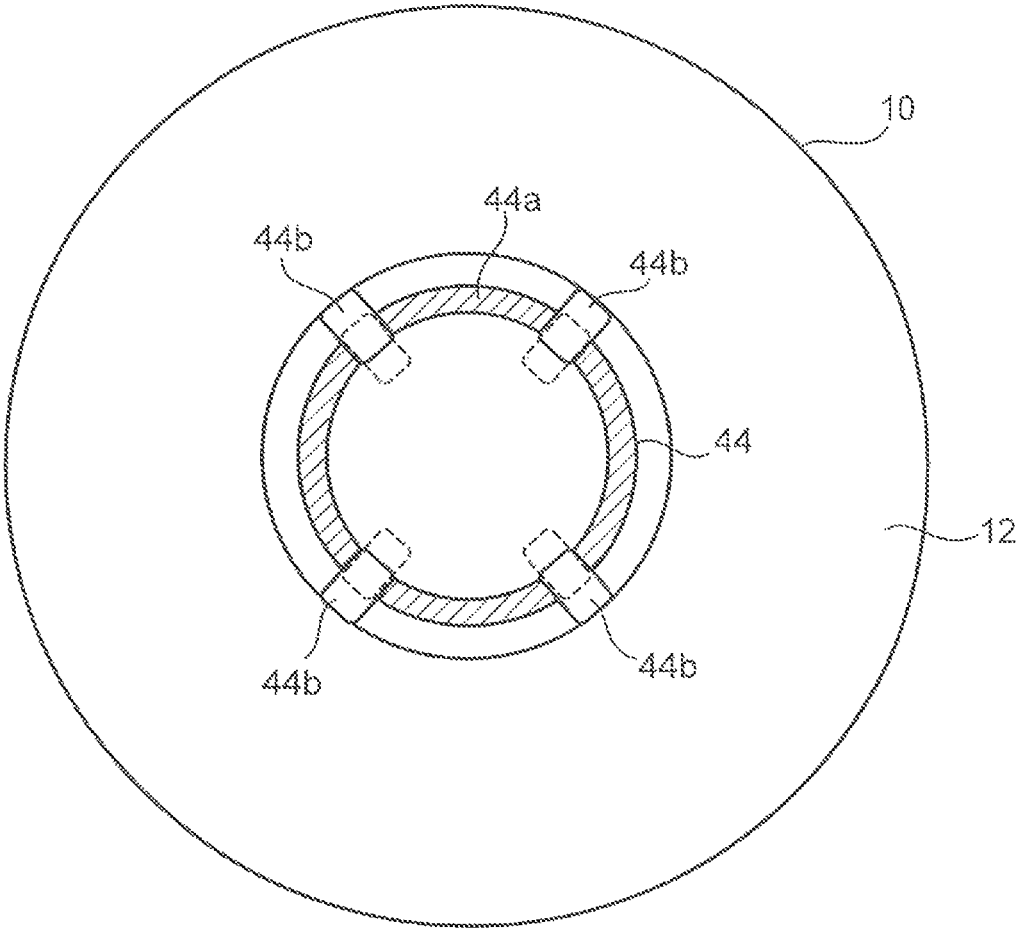
FIG. 5 is a cross-sectional view of the line V-V of FIG. 2.
Figure 6:
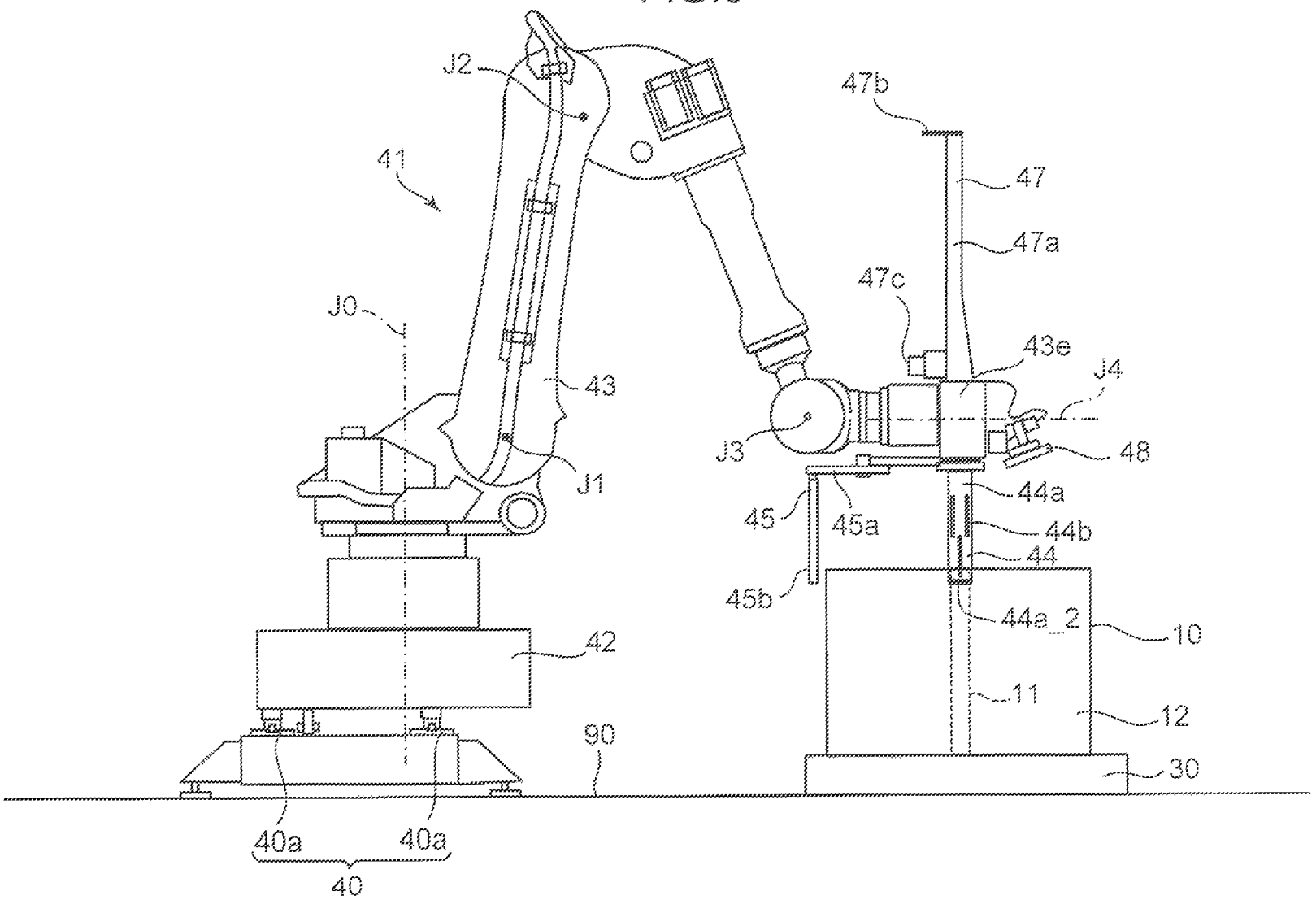
FIG. 6 is a schematic side view showing how a transportation-side holder holds a roll mounted on a roll mounting section.

The transportation-side holder 44 includes a roll holding shaft 44*a* extending along the direction orthogonal to the fourth axis J4 from an attachment side surface (attached portion) 43*f* that is one side surface of the head 43*e* of the arm 43, and a plurality of press-contact sections 44*b* (refer to FIG. 5 and FIG. 6). The transportation-side holder 44 is fixed to the attachment side surface 43*f* rotatably about the central axis J5 of the roll holding shaft 44*a* and the transportation-side holder 44. The transportation-side holder 44 is driven to rotate about the central axis J5 by a hand section rotating motor 302 (refer to FIG. 19).

The roll holding shaft 44*a* has a shape that enables insertion into the core member 11 of the roll 10. An outside diameter of the roll holding shaft 44*a* is slightly smaller than an inside diameter of the core member 11.

Specifically, the roll holding shaft 44*a* includes a proximal section rotatably fixed to the attachment side surface 43*f*, and a distal section 44*a*_2 that is an end of a longitudinal direction of the roll holding shaft 44*a*. This distal section 44*a*_2 is a free end. The roll holding shaft 44*a* is inserted into the core member 11 by the distal section 44*a*_2, which is the free end, being inserted into the core member 11. That is, the roll 10 is attached to the roll holding shaft 44*a* from a distal section 44*a*_2 side. Then, from the roll holding shaft 44*a*, the roll 10 is pulled out from the distal section 44*a*2 side.

FIG. 5 is a cross-sectional view of the line V-V of FIG. 2. As shown in FIG. 5, each press-contact section 44*b* is displaceable between a press-contact position that is a position shown in a solid line of FIG. 5 and protrudes outward in a radial direction of the roll holding shaft 44*a* from a peripheral surface of the roll holding shaft 44*a*, and a waiting position that is a position shown in a broken line of FIG. 5 and retracts inward in the radial direction of the roll holding shaft 44*a* from the press-contact position. Each press-contact section 44*b* is press-contacted to an inner peripheral surface of the core member 11 in a state of being at the press-contact position. In a state of being at the waiting position, in the radial direction of the roll holding shaft 44*a*, a position of the peripheral surface of the roll holding shaft 44*a* and a position of the peripheral surface of each press-contact section 44*b* are almost the same.

Figure 19:
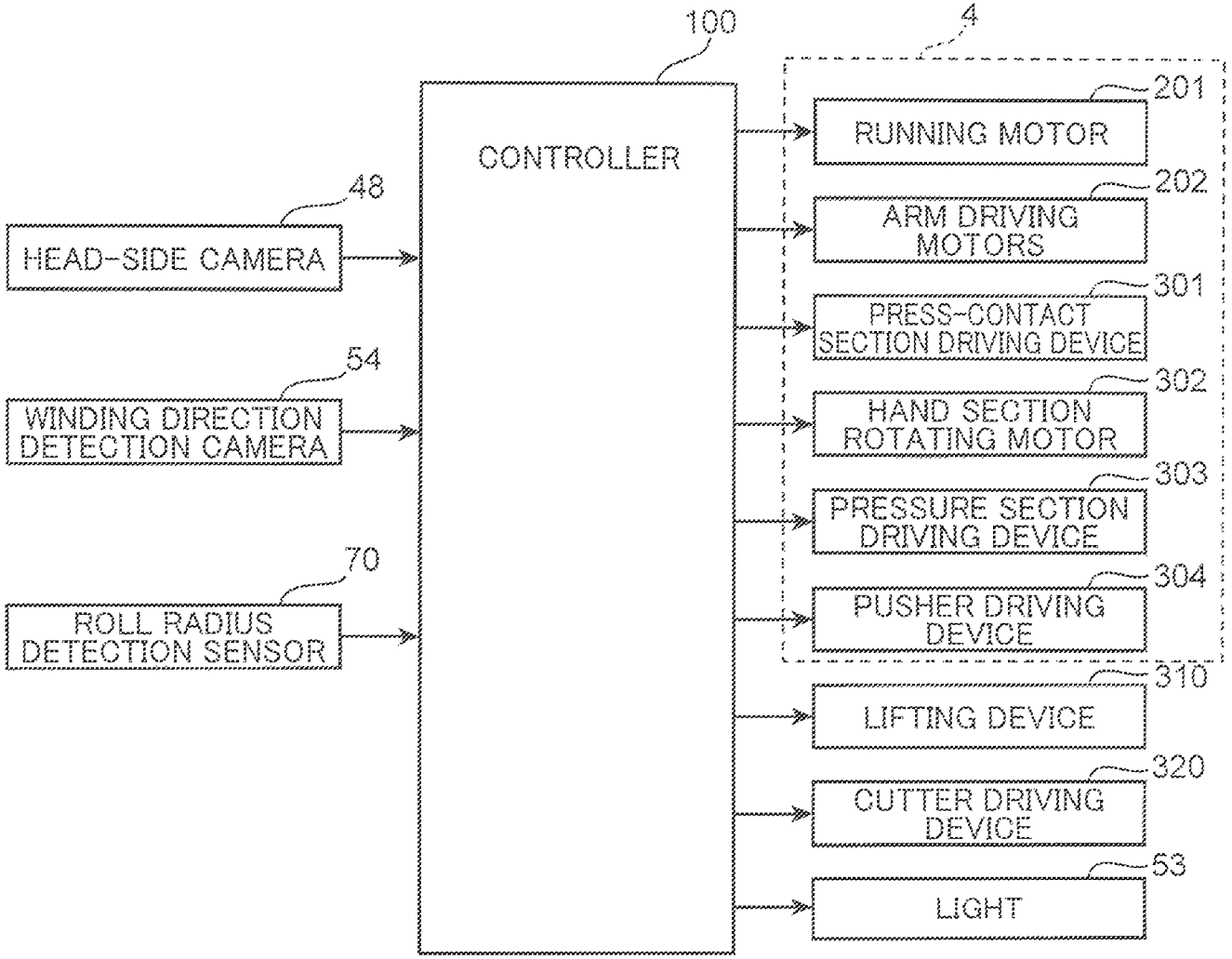
FIG. 19 is a block diagram showing input and output of the controller.

Each press-contact section 44*b* is driven by a press-contact section driving device 301 attached to the head 43*e* (refer to FIG. 19). The press-contact section driving device 301 drives the press-contact sections 44*b* by a mechanical drive mechanism, air, or the like.

As shown in FIG. 5 and FIG. 2, a plurality of holes is formed in the peripheral surface of the roll holding shaft 44*a*. The press-contact section 44*b* is provided in each hole. Each press-contact section 44*b* is a plate-shaped member extending along an axial direction of the roll holding shaft 44*a*. Each press-contact section 44*b* is displaceably disposed between the press-contact position and the waiting position at a plurality of positions in a direction along the axial direction of the roll holding shaft 44*a* and at a plurality of positions in the circumferential direction of the roll holding shaft 44*a*. A protrusion is provided on an outside surface of each press-contact section 44*b*. When the press-contact section 44*b* is displaced to the press-contact position, a tip of the protrusion will bite into the core member 11 of the roll 3.

The transportation-side holder 44 configured in this way holds the roll 10, by being inserted into the core member 11 of the roll 10 in a state where the press-contact sections 44*b* are at the waiting position, and subsequently the press-contact sections 44*b* moving to the press-contact position and press-contacting the inner peripheral surface of the core member 11.

As shown in FIG. 6, in order to hold the roll 10 mounted on the roll mounting section 3, the transportation-side holder 44 is disposed above the roll 10 in a state where the roll holding shaft 44*a* extends downward from the head 43*e*. Then, as the transportation-side holder 44 falls from this state toward the roll 10, the roll holding shaft 44*a* is inserted into the core member 11 of the roll 10. Subsequently, the press-contact sections 44*b* are press-contacted to the inner peripheral surface of the core member 11.

(ii) Pressure Section

The pressure section 45 is for restraining the sheet 12 on an outermost peripheral surface of the sheet 12 of the roll 10 held by the transportation-side holder 44 on a peripheral surface of the roll 10.

Specifically, in the present embodiment, a tape T (refer to FIG. 18) is affixed on the end of the sheet 12 on the outermost peripheral surface of each roll 10 carried in to the roll mounting section 3. The end of the sheet 12 is restrained on the peripheral surface of the roll 10 by this tape T. Therefore, in order to feed the sheet 12 from the roll 10 in the sheet supply device 2, it is necessary to detach this tape T. In contrast, as will be describe later, the present embodiment is configured such that the tape T is eliminated until the roll 10 is conveyed from the roll mounting section 3 to the sheet supply device 2. Here, when the tape T is eliminated and the sheet 12 is no longer restrained on the roll 10 in this way, there is a fear that the end of the sheet 12 is turned over and moves to a position distant from the roll 10. Therefore, in the present embodiment, the pressure section 45 is provided, and the pressure section 45 controls the end of the sheet 12 from moving to a position separated from the roll 10.

As shown in FIG. 2 and FIG. 3, the pressure section 45 includes a support plate 45*a* coupled with one side surface of the head 43*e*, and a generally cylindrical pressure section body 45*b* extending in parallel with an axis of the transportation-side holder 44 from a tip of the support plate 45*a*. As shown in FIG. 3, the support plate 45*a* is coupled with the head 43*e* pivotably about the axis extending in parallel with the axis of the transportation-side holder 44 (central axis of the roll holding shaft 44*a*). The support plate 45*a* is driven to pivot by a pressure section driving device 303 (refer to FIG. 19). As the support plate 45*a* is pivotally displaced, the pressure section body 45*b* moves toward and away from the transportation-side holder 44.

In the pressure section 45 configured in this way, in a normal state, as shown in a solid line of FIG. 3, the pressure section body 45*b* is separated most from the transportation-side holder 44. Meanwhile, when the sheet 12 on the outermost peripheral surface of the roll 10 is eliminated as described above, the support plate 45*a* is driven to pivot. Accordingly, as shown in a broken line of FIG. 3, the pressure section 45 is in a state where the pressure section body 45*b* abuts on an outside surface of the roll 10 from outside of the radial direction of the roll 10. With this abutment, the pressure section 45 presses down, on the roll 10, the end or its neighborhood of the sheet 12 on the outermost peripheral surface of the roll 10, and restrains the end on the peripheral surface of the roll 10. Note that the pressure section 45 preferably presses down the sheet 12 on the outermost peripheral surface over the whole area of the width direction. However, the pressure section 45 is required at least to be configured to control movement of the end of the sheet 12. Therefore, the pressure section 45 may press down only part of the width direction of the sheet 12.

Note that the pressure section driving device 303 drives the support plate 45*a* of the pressure section 45 by air or the like.

(iii) Pusher

The pusher 46 is for pushing out the roll 10 held by the transportation-side holder 44, and detaching the roll 10 from the transportation-side holder 44.

As shown in FIG. 3, the pusher 46 is an annular member surrounding the transportation-side holder 44. An outside diameter of the pusher 46 is set greater than an outside diameter of the core member 11 of the roll 10. The pusher 46 is slidably coupled with the head 43*e* by a slide mechanism 46*b* (refer to FIG. 7) along the axial direction of the roll holding shaft 44*a*. The pusher 46 is driven to slide by a pusher driving device 304 (refer to FIG. 19).

Figure 7:
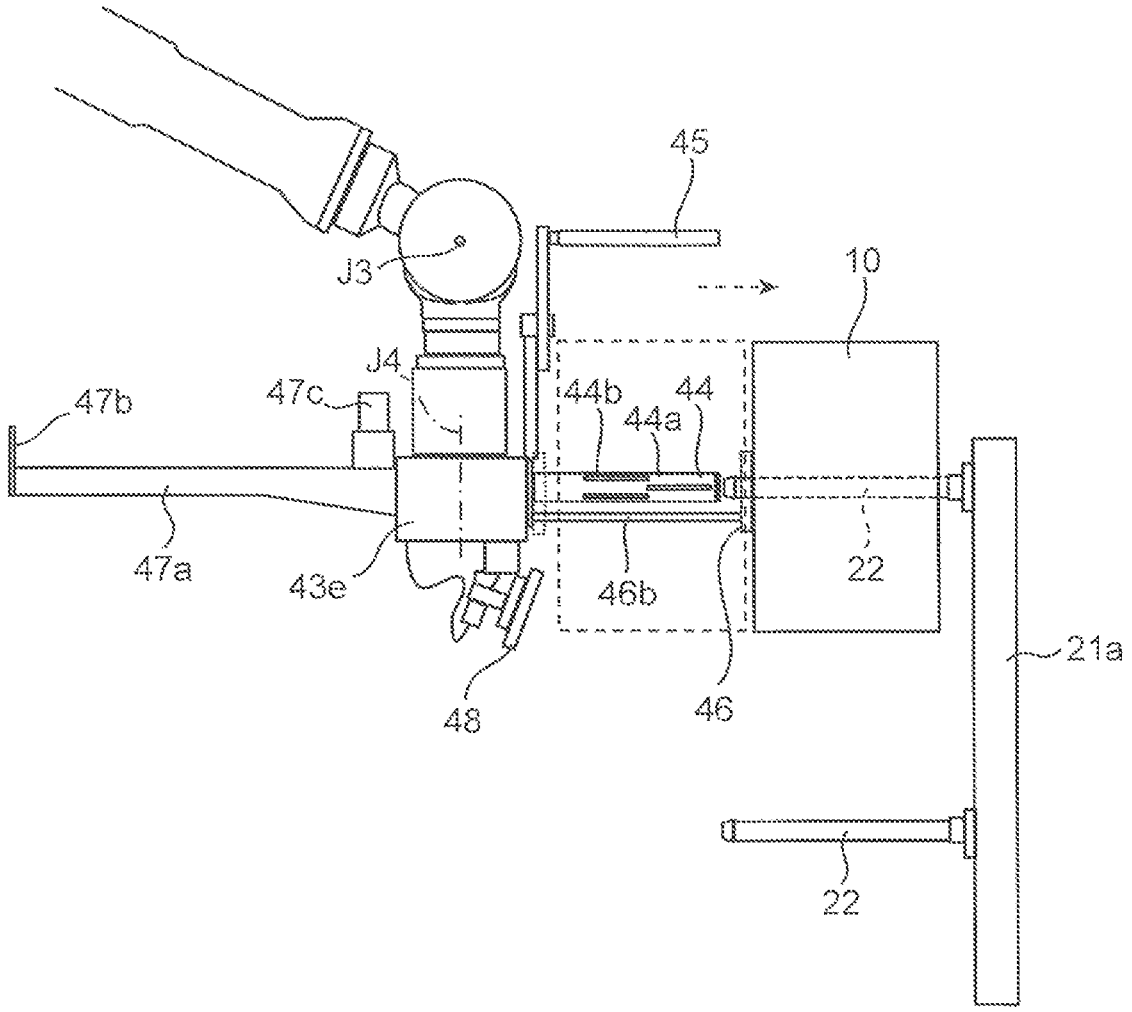
FIG. 7 is a schematic side view showing how the roll is detached from the transportation-side holder.

The pusher driving device 304 moves the pusher 46, as shown in a broken line of FIG. 7, between a position near the side surface (attachment side surface) 43*f* of the head 43*e* and a position further outside the tip of the roll holding shaft 44*a* as shown in a solid line of FIG. 7. Through such movement, the pusher 46 pushes out the roll 10 held by the transportation-side holder 44 outside the tip, and detaches the roll 10 from the transportation-side holder 44.

Here, FIG. 7 is a diagram showing how the roll 10 held by the transportation-side holder 44 is delivered to the supporting shaft 22 of the sheet supply device 2. As shown in this FIG. 7, during this delivery, first, the transportation-side holder 44 is disposed at a position where the tip of the transportation-side holder 44 faces the supporting shaft 22, and the central axis J5 of the transportation-side holder 44 mostly agrees with the central axis of the supporting shaft 22. Then, the tip of the supporting shaft 22 is inserted into the core member 11 of the roll 10 of a portion protruding from the tip of the transportation-side holder 44. Subsequently, as the roll 10 is pushed out to the tip side of the transportation-side holder 44 by the pusher 46, the roll 10 is delivered to the supporting shaft 22. Note that when the roll 10 is detached from the transportation-side holder 44, the press-contact sections 44*b* are at the waiting position, and the pressure section body 45*b* is retracted to a position separated from the peripheral surface of the roll 10.

Note that the pusher driving device 304 drives the pusher 46 by air or the like.

(iv) Core Member Detachment Section

The core member detachment section 47 is for detaching the core member 11 from the supporting shaft 22 of the sheet supply device 2. That is, in the present embodiment, the operation robot 41 is also configured to detach the core member 11 of the used roll 10 supported by the supporting shaft 22 of the sheet supply device 2. Note that in the present embodiment, the use of the roll 10 is finished with the sheet 12 remaining in the core member 11. Accordingly, the core member detachment section 47 detaches the core member 11 with the sheet 12 wound.

As shown in FIG. 2, FIG. 4, and other figures, the core member detachment section 47 is provided on an opposite side surface of the head 43*e* of the arm 43 from the attachment side surface 43*f*.

The core member detachment section 47 includes a substrate 47*a* extending from one side surface of the head 43*e* of the arm 43 in a direction orthogonal to the fourth axis J4, a claw 47*b* provided at a tip of the substrate 47*a* and extending from the substrate 47*a* in a direction orthogonal to a longitudinal direction of the substrate 47*a*, and a pair of clamping sections 47*c* provided at a proximal end of the substrate 47*a*.

In a state shown in FIG. 4, a notch 47*g* recessed downward (substrate 47*a* side) is formed at an upper edge of the claw 47*b*.

The clamping sections 47*c* are for grasping the core member 11. As shown in FIG. 4, the pair of clamping sections 47*c* and 47*c* is arranged along a width direction of the substrate 47*a*. These clamping sections 47*c* and 47*c* are driven in a direction toward and away from each other, as shown in a solid line and a broken line of FIG. 4.

Figure 8:
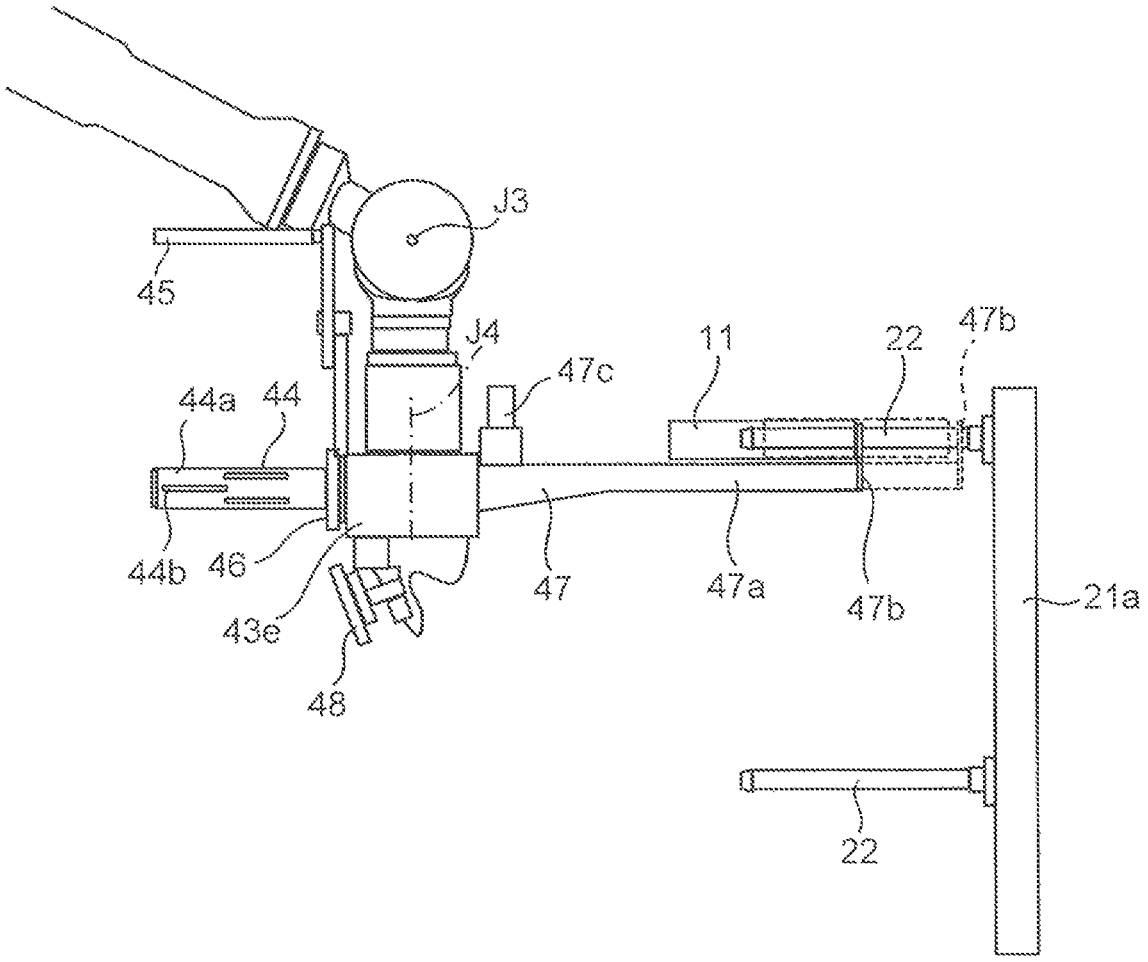
FIG. 8 is a schematic side view showing how a core member is drawn from a supporting shaft.

An operation when the core member detachment section 47 configured in this way detaches the used roll 10 from the supporting shaft 22 will be described with reference to FIG. 8 and FIG. 9.

First, the core member detachment section 47 is disposed below the supporting shaft 22 in a state where the substrate 47*a* and the supporting shaft 22 extend in parallel, and the claw 47*b* extends upward from the substrate 47*a* (toward the supporting shaft 22). Next, the core member detachment section 47 is elevated such that a lower portion of the supporting shaft 22 enters the notch 47*g* of the claw 47*b*. Next, as shown in a broken line of FIG. 8, the core member detachment section 47 is moved in a direction separated from the supporting wall 21*a*, and is disposed at a position where the claw 47*b* abuts on the end of the core member 11 (end on a side of the supporting wall 21*a*).

Then, subsequently, the core member detachment section 47 is driven in a direction separated from the supporting wall 21*a* along the axial direction of the supporting shaft 22, as shown in a solid line of FIG. 8. Accordingly, the claw 47*b* pulls out the core member 11 in a direction separated from the supporting wall 21*a*. At this time, the core member detachment section 47 does not completely pull out the core member 11 from the supporting shaft 22, and the supporting shaft 22 is inserted into part of the core member 11. Note that in order to clarify the diagram, FIG. 8 shows the supporting shaft 22 inserted into the core member 11 in a solid line.

Subsequently, as shown in a solid line of FIG. 9, the clamping sections 47*c* clamp the end of the pulled-out used roll 10. Then, in this state, the core member detachment section 47 moves in a direction separated from the supporting shaft 22. Accordingly, the used roll 10 is completely pulled out from the supporting shaft 22.

Figure 9:
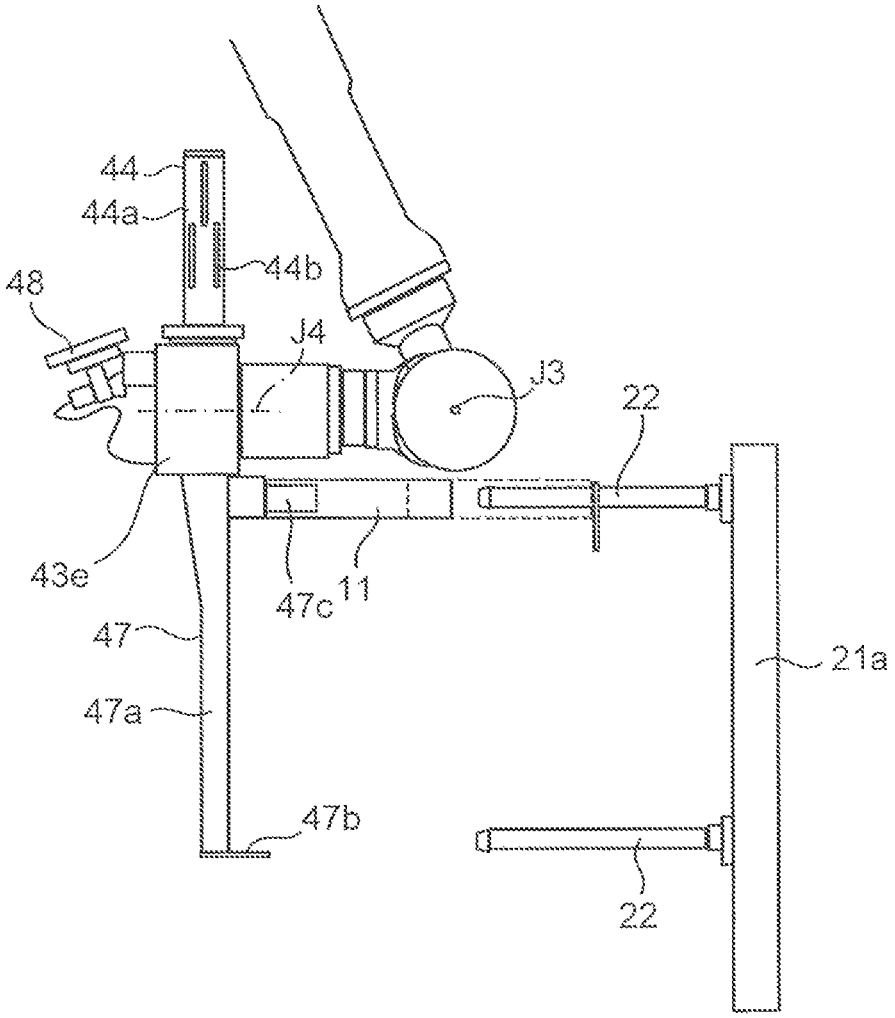
FIG. 9 is a schematic side view showing how the core member is detached from the supporting shaft.

More particularly, as shown in FIG. 9, the core member detachment section 47 is disposed such that the core member detachment section 47 extends downward from the head 43*e*, and such that the used roll 10 enters between the clamping sections 47*c* and 47*c*. Then, the clamping sections 47*c* and 47*c* are driven in a direction to approach each other, and the clamping sections 47*c* and 47*c* put the end of the used roll 10 therebetween. In this state, the core member detachment section 47 is moved in a direction separated from the supporting wall 21*a*, and accordingly, the used roll 10 is pulled out from the supporting shaft 22.

Note that a drive mechanism for the clamping sections 47*c* and 47*c* drives the clamping sections 47*c* and 47*c* by air or the like. Also, the used roll 10 held by the clamping sections 47*c* is conveyed to a scrapping place (not shown) and scrapped.

(v) Head-Side Camera

As shown in FIG. 2, FIG. 3, and other figures, the head-side camera 48 is attached to the head 43*e*. The head-side camera 48 is provided to mainly identify a position of the core member 11 of the roll 10 mounted on the roll mounting section 3. Specifically, an image captured by the head-side camera 48 is sent to the controller 100. Based on the image captured by the head-side camera 48, the controller 100 detects a central position of the core member 11 of the roll 10 mounted on the roll mounting section 3.

Thus, in the present embodiment, the head-side camera 48 and the controller 100 function as a core position detection device that detects the position of the core member 11 of the roll 10 mounted on the roll mounting section 3. Note that the controller 100 also detects a schematic size of the outside diameter of the roll 10 based on the captured image. In addition, based on the detected outside diameter size of the roll 10, the controller 100 determines whether the roll 10 mounted on the roll mounting section 3 is a roll of a prescribed size. Also, as will be describes later, the controller 100 functions as part of the core position detection device, and functions as a controller that controls the running motor 201 and the arm driving motors 202.

In the present embodiment, the detected central position of the core member 11 is used when the transportation-side holder 44 holds the roll 10 mounted on the roll mounting section 3. Specifically, the posture and position of the roll holding shaft 44*a* are adjusted based on the detected central position of the core member 11 to allow the roll holding shaft 44*a* to be appropriately inserted into the core member 11 of the roll 10. For example, the posture and position of the roll holding shaft 44*a* are adjusted such that the distal section 44*a*_2 of the roll holding shaft 44*a* faces downward and the central position of the core member 11 is on the central axis J5.

Here, in the present embodiment, in order of conveying the roll 10, priority has been determined for mounting places in the roll mounting section 3. According to this priority, the head-side camera 48 first captures an overall image of the rolls 10 mounted on the roll mounting section 3. Next, based on the captured image, the roll 10 mounted on a place where priority is the highest (to be conveyed at an earlier stage) is identified. Then, the head 43*e* is moved to a neighborhood of the identified roll 10 to be conveyed. Subsequently, the position of the core member 11 of the roll 10 to be conveyed is detected. Then, based on this position, the position of the transportation-side holder 44 is adjusted more minutely.

For example, when the rolls 10 are mounted in a plurality of stacks in the vertical direction on the roll mounting section 3, higher priority is set as the roll 10 is positioned at a higher place.

The roll 10 is held by the transportation-side holder 44 by the following procedure.

First, the head 43*e* is disposed at a position equal to or higher than a predetermined height from the roll mounting section 3, the position where the head-side camera 48 captures all the rolls 10 mounted on the roll mounting section 3. Next, based on an image captured by the head-side camera 48, the controller 100 calculates a separation distance between the head 43*e* and the roll 10 positioned at the highest place. For example, the distance is calculated from a size of the core member 11 of the roll 10 in the captured image.

Next, based on the distance, the head 43*e* is lowered to a position close to the roll 10 positioned at the highest place. In this state, the controller 100 detects the central position of the core member 11 of the roll 10 again based on the image captured by the head-side camera 48. Next, based on a detection result of the central position of the core member 11, the posture of the roll holding shaft 44*a* is defined as the posture in which the distal section 44*a*_2 faces downward. Also, the posture and position of the transportation-side holder 44 are adjusted such that the detected central position of the core member 11 is on the central axis J5 of the transportation-side holder 44. Subsequently, the roll holding shaft 44*a* and the transportation-side holder 44 are lowered toward the roll 10, thereby inserting the roll holding shaft 44*a* into the core member 11 of the roll 10.

Note that priority may be determined to order of conveying the roll 10 in the horizontal direction as well. For example, priority may be set according to a distance from the rail 40. For example, the roll 10 disposed at a position closer to the rail 40 may be first conveyed sequentially.

(2-4) Intermediate Processing Device

The intermediate processing device 5 is a device for performing intermediate processing. The intermediate processing is processing to be performed during a period after the roll 10 is carried into the roll mounting section 3 until the roll 10 is set in the supporting shaft 22 of the sheet supply device 2. Also, the intermediate processing is processing to be performed on the roll 10 such that the roll 10 enters a state where the sheet 12 can be fed continuously from the roll 10. As this intermediate processing, the present embodiment performs processing for detecting a winding direction of the roll 10, processing for causing the transportation-side holder 44 to re-hold the roll 10 (to be performed as necessary), and processing for eliminating the sheet 12 on the outermost peripheral surface of the roll 10. Also, as the intermediate processing, the present embodiment also performs processing for detecting a radius of the roll 10.

Figure 10:
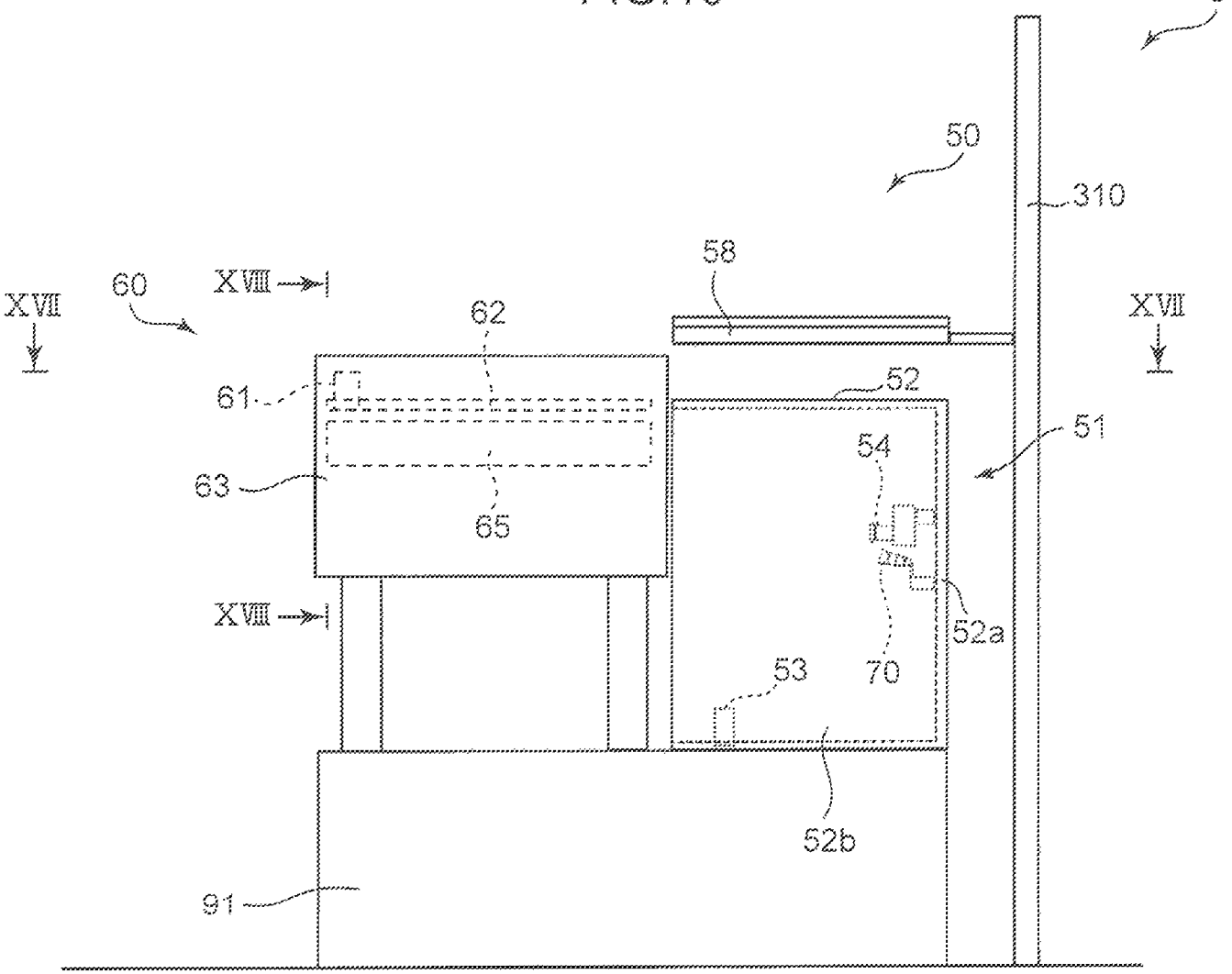
FIG. 10 is a schematic side view of an intermediate processing device.

FIG. 10 is a schematic side view of the intermediate processing device 5. The intermediate processing device 5 includes a winding direction detection device 51, a mounting stand (re-hold mounting section) 58, a sheet elimination device 60, and a roll radius detection sensor 70 (roll radius detection device).

(i) Roll Radius Detection Sensor

The roll radius detection sensor 70 is a sensor for detecting the radius of the roll 10 held by the transportation-side holder 44. In the present embodiment, as shown in FIG. 11, which is a cross-sectional view of the line XI-XI of FIG. 1, inside a light-shielding box 52 to be described later, the roll radius detection sensor 70 is attached to a rear wall 52*a* to be described later of the light-shielding box 52.

The roll radius detection sensor 70 is a so-called distance sensor. In a state where a distance between the central axis of the roll 10 and the roll radius detection sensor 70 is a reference distance set in advance, the roll radius detection sensor 70 measures a distance from the roll radius detection sensor 70 to the peripheral surface of the roll 10. This measurement result is sent to the controller 100. The controller 100 detects the radius of the roll 10 based on this measurement result and the reference distance.

In the present embodiment, the radius of the roll 10 is detected while the roll 10 is held by the transportation-side holder 44.

Figure 11:
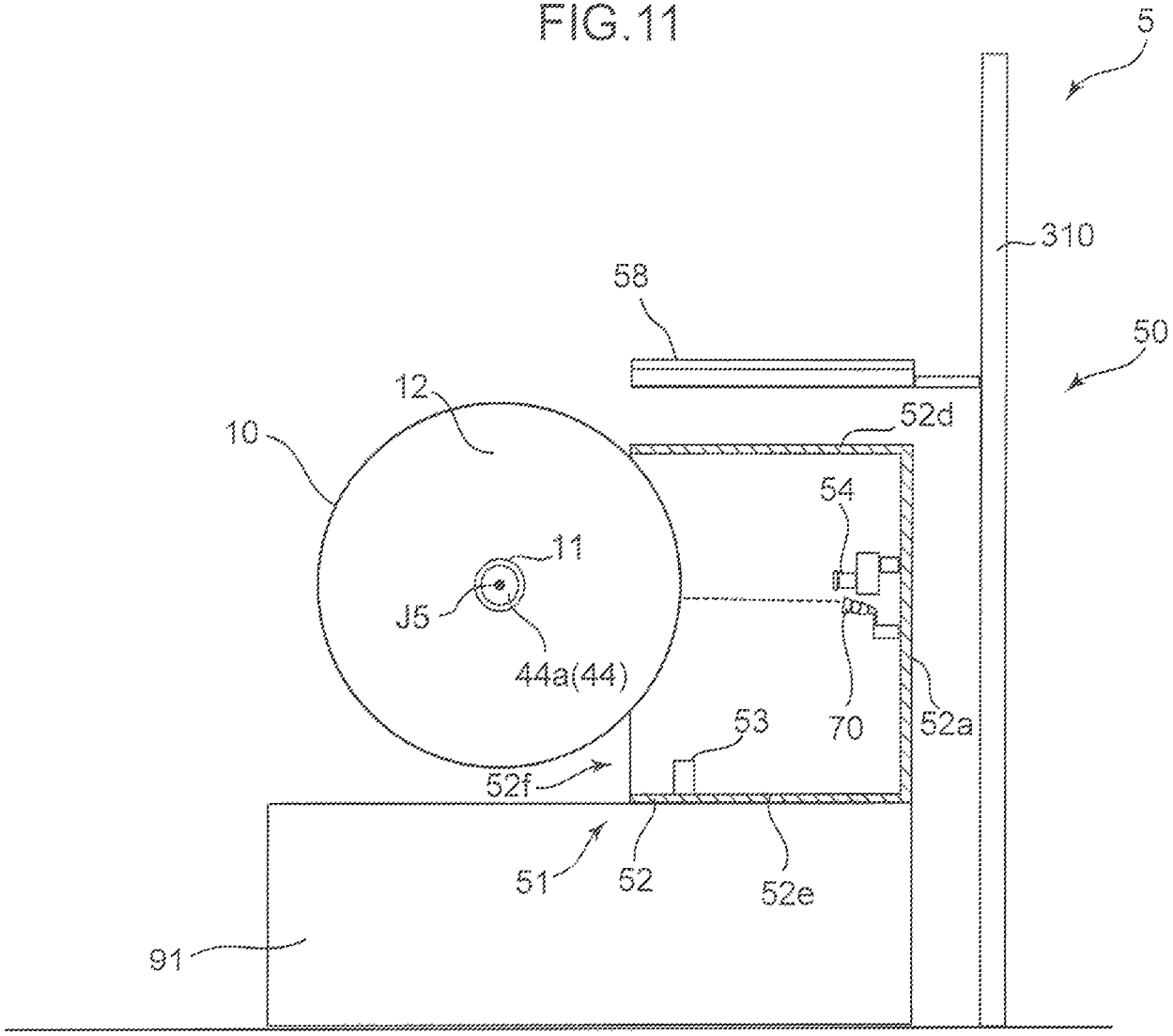
FIG. 11 is a cross-sectional view of the line XI-XI of FIG. 1.

Specifically, as shown in FIG. 11, the transportation-side holder 44 is disposed such that the central axis J5 of the transportation-side holder 44 extends in the front and rear direction, and that a right and left distance between the central axis J5 and the roll radius detection sensor 70 is the reference distance. In this state, the roll radius detection sensor 70 measures the distance to the peripheral surface of the roll 10. Subsequently, the controller 100 detects a value obtained by subtracting this measured distance from the reference distance as the radius of the roll 10.

In the present embodiment, the radii of the roll 10 are detected at a plurality of positions in a circumferential direction of the roll 10. The controller 100 defines an average of these radii as the radius of the roll 10.

Specifically, the transportation-side holder 44 is driven to rotate about the central axis J5. Then, the roll radius detection sensor 70 measures the distance to the peripheral surface of the roll 10 at a plurality of timings when a rotation angle of the transportation-side holder 44 differs. Accordingly, the radii of the roll 10 are detected at the plurality of positions in the circumferential direction of the roll 10. Then, an average of radius at the plurality of positions is calculated.

(ii) Winding Direction Detection Device

The winding direction detection device 51 and the mounting stand 58 are devices for causing the transportation-side holder 44 to hold the roll 10 in an appropriate direction.

Specifically, as described above, in the present embodiment, the roll 10 can enter the roll holding shaft 44*a* only from the distal section 44*a*_2 side. Meanwhile, when the roll 10 is pulled out from the roll holding shaft 44*a*, the roll 10 can be pulled out only from the distal section 44*a*_2 side of the roll holding shaft 44*a*. Therefore, the winding direction of the roll 10 is restricted in a state where the roll 10 is delivered from the transportation-side holder 44 to the supporting shaft 22 and the roll 10 is held by the supporting shaft 22, as shown in FIG. 7. Specifically, the winding direction of the roll 10 in this state will be restricted to the winding direction of the roll 10 when the roll holding shaft 44*a* is inserted into the core member 11 of the roll 10, that is, when the transportation-side holder 44 holds the roll 10.

Meanwhile, as described above, in the sheet supply device 2, the rotation direction of the roll 10 when the sheet 12 is fed from the roll 10 is determined for each supporting shaft 22. Therefore, it is necessary to set the roll 10 in the supporting shaft 22 in accordance with the rotation direction of the supporting shaft 22.

For example, in the example shown in FIG. 2, as described above, the roll 10 supported by the supporting shaft 22 positioned on the left side rotates clockwise viewed from the tip side of the supporting shaft 22 to feed the sheet 12. Meanwhile, the roll 10 supported by the supporting shaft 22 positioned on the right side rotates counterclockwise viewed from the tip side of the supporting shaft 22 to feed the sheet 12. Therefore, it is necessary to set, in the supporting shaft 22, the roll 10 with the winding direction that matches the rotation direction of the supporting shaft 22.

Therefore, when the winding direction of the roll 10 held by the transportation-side holder 44 does not correspond to the feeding direction of the sheet 12, the transportation-side holder 44 needs to re-hold the roll 10 before the roll 10 is delivered from the transportation-side holder 44 to the supporting shaft 22. For example, when the roll 10 needs to be set in the supporting shaft 22 such that the winding direction of the roll 10 viewed from the tip side of the supporting shaft 22 is clockwise, the transportation-side holder 44 needs to hold the roll 10 in a state where the winding direction viewed from the tip side of the roll holding shaft 44*a* is counterclockwise.

Therefore, in the present embodiment, the winding direction detection device 51 detects the winding direction of the roll 10. Then, it is determined based on this detection result whether to re-hold the roll 10. Specifically, when the detected winding direction of the roll 10 fails to correspond to the feeding direction of the sheet 12, the insertion direction of the roll holding shaft 44*a* into the core member 11 is changed by using the mounting stand 58, and the transportation-side holder 44 re-holds the roll 10, as will be described later.

Figure 12:
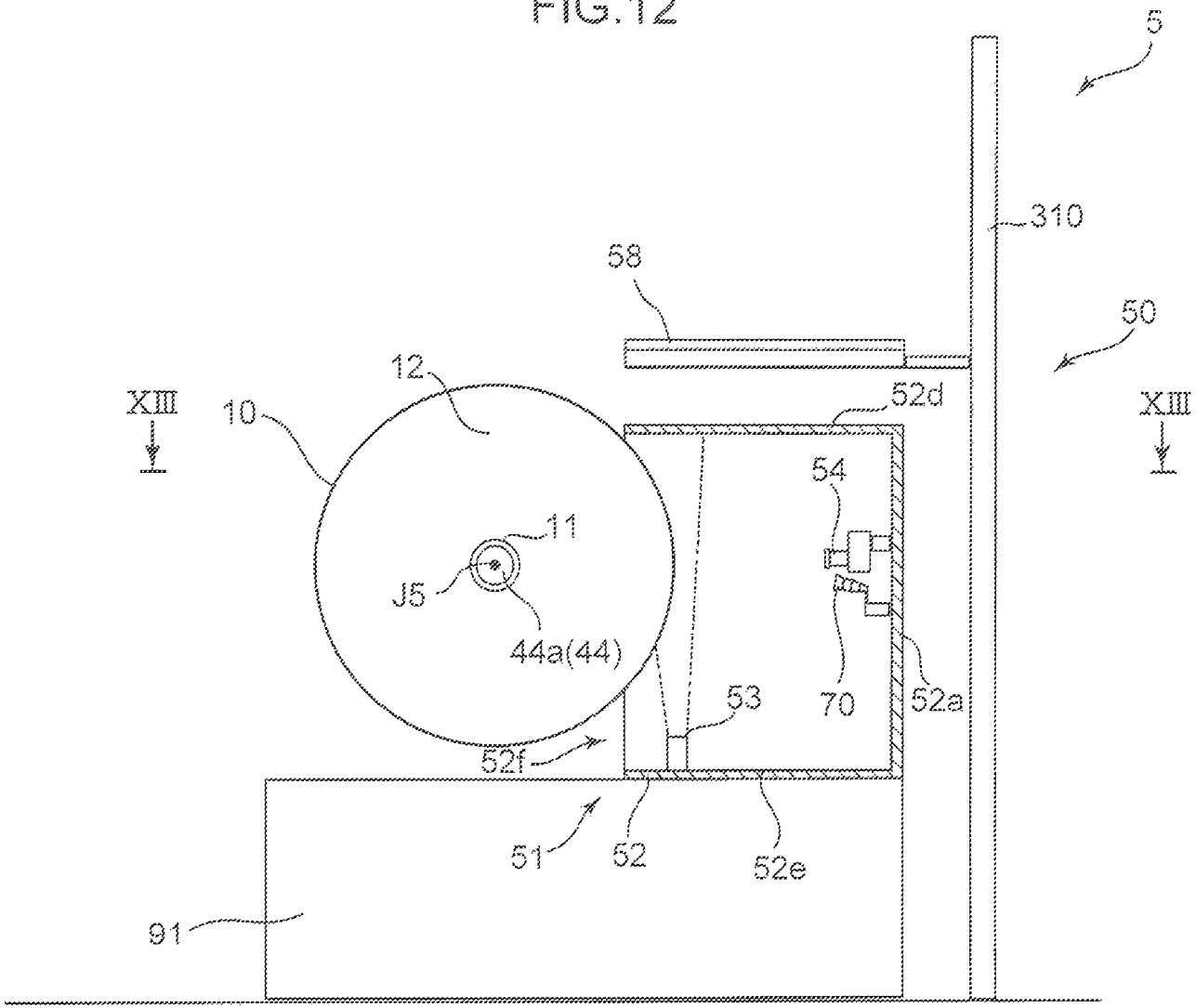
FIG. 12 is a diagram corresponding to FIG. 11, and is a diagram for describing a procedure for detecting a winding direction of the roll.
Figure 13:
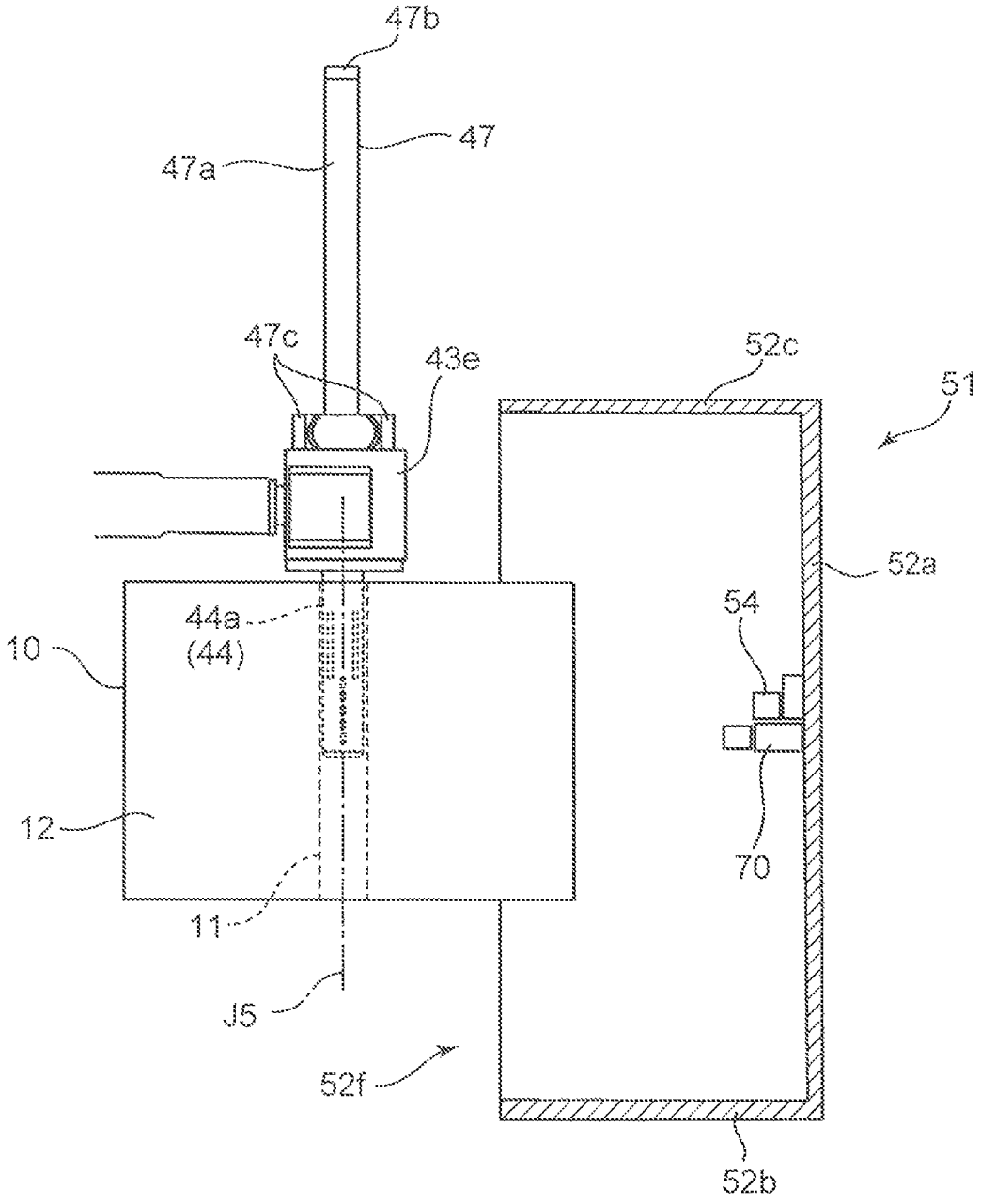
FIG. 13 is a cross-sectional view of the line XIII-XIII of FIG. 12.

FIG. 12 is a diagram corresponding to FIG. 11. FIG. 13 is a cross-sectional view of the line XIII-XIII of FIG. 12.

The winding direction detection device 51 includes the light-shielding box 52, and a light 53 and a winding direction detection camera 54 provided inside the light-shielding box 52. Note that the light-shielding box 52 shields disturbance light when the winding direction detection camera 54 captures an image. If a light quantity sufficient for the winding direction detection camera 54 to detect the winding direction can be obtained, the light-shielding box may be omitted.

The light-shielding box 52 is a box-shaped member having an opening to the left side (rail 40 side). Specifically, the light-shielding box 52 includes the rear wall 52*a* extending in the vertical direction and the front and rear direction, lateral walls 52*b* and 52*c* extending leftward from both edges of the front and rear direction of the rear wall 52*a*, an upper wall 52*d* horizontally extending over upper edges of the lateral walls 52*b* and 52*c*, and a lower wall 52*e* horizontally extending over lower edges of the lateral walls 52*b* and 52*c*. Then, in the light-shielding box 52, an opening 52*f* surrounded by left edges of the lateral walls 52*b* and 52*c*, the upper wall 52*d*, and the lower wall 52*e* is formed.

As shown in FIG. 10 to FIG. 13, the opening 52*f* has a size that allows insertion of part of the peripheral surface of the roll 10 into the light-shielding box 52 from the opening 52*f*. In a state where part of the peripheral surface of the roll 10 is inserted into the light-shielding box 52 from the opening 52*f*, the winding direction of the roll 10 is detected. Also, in a state where the roll 10 is held by the transportation-side holder 44, the winding direction of the roll 10 is detected.

Specifically, in a state where the roll holding shaft 44*a* has a posture extending in the front and rear direction, part of the circumferential direction of the peripheral surface of the roll 10 held by the transportation-side holder 44 is inserted into the light-shielding box 52 over the overall width direction of the sheet 12. A size of the front and rear direction of the opening 52*f* is set as a value sufficiently larger than a size of the axial direction of the roll 10 having the maximum size of the axial direction (size of the width direction of the sheet 12) out of the rolls 10 to be used.

The light 53 is attached to a position near the opening 52*f* on the lower wall 52*e* of the light-shielding box 52. The light 53 emits light upward, and illuminates the peripheral surface of the roll 10 inserted into the light-shielding box 52.

The winding direction detection camera 54 is attached to a generally center of the vertical direction of the rear wall 52*a* of the light-shielding box 52. The winding direction detection camera 54 captures an image of the peripheral surface of the roll 10 inserted into the light-shielding box 52 from the opening 52*f*.

The image captured by the winding direction detection camera 54 is sent to the controller 100. The controller 100 detects the winding direction of the roll 10 from the image captured by the winding direction detection camera 54. Thus, in the present embodiment, the winding direction detection camera 54 and the controller 100 function as the winding direction detection device that detects the winding direction of the roll 10.

Specifically, the controller 100 detects a shadow formed on the end of the sheet 12 positioned on the outermost peripheral surface of the roll 10. The controller 100 detects the winding direction of the roll 10 with a direction of this shadow. That is, in a state where the peripheral surface of the roll 10 is inserted into the light-shielding box 52 and external light is controlled, when the peripheral surface of the roll 10 is irradiated with light from the light 53, if the end of the sheet 12 goes upward from a lower place, a shadow extending along the winding direction of the roll 10 from this end is formed around the end of the sheet 12 positioned on the peripheral surface of the roll 10. Meanwhile, when the end of the sheet 12 goes downward from an upper place, strong reflected light is reflected from this end. Therefore, the controller 100 detects the direction of the shadow or the reflected light from the image captured by the winding direction detection camera 54, and determines the winding direction of the roll 10.

Here, it is unknown at which position of the peripheral surface of the roll 10 the end of the sheet 12 is placed.

Therefore, the present embodiment detects the shadow and the direction of the shadow over the entire area of the circumferential direction of the peripheral surface of the roll 10. Specifically, the transportation-side holder 44 is driven to rotate about its central axis J5, and an area captured by the winding direction detection camera 54 is changed sequentially. The transportation-side holder 44 makes one revolution. The controller 100 detects the direction of the shadow of the end of the sheet 12 and the reflected light from the image captured over the overall peripheral surface of the roll 10 in the circumferential direction. The controller 100 then determines the winding direction of the roll 10. At this time, the position of the end of the sheet 12 in the peripheral surface of the roll 10 is also detected together.

(iii) Mounting Stand

Figure 14:
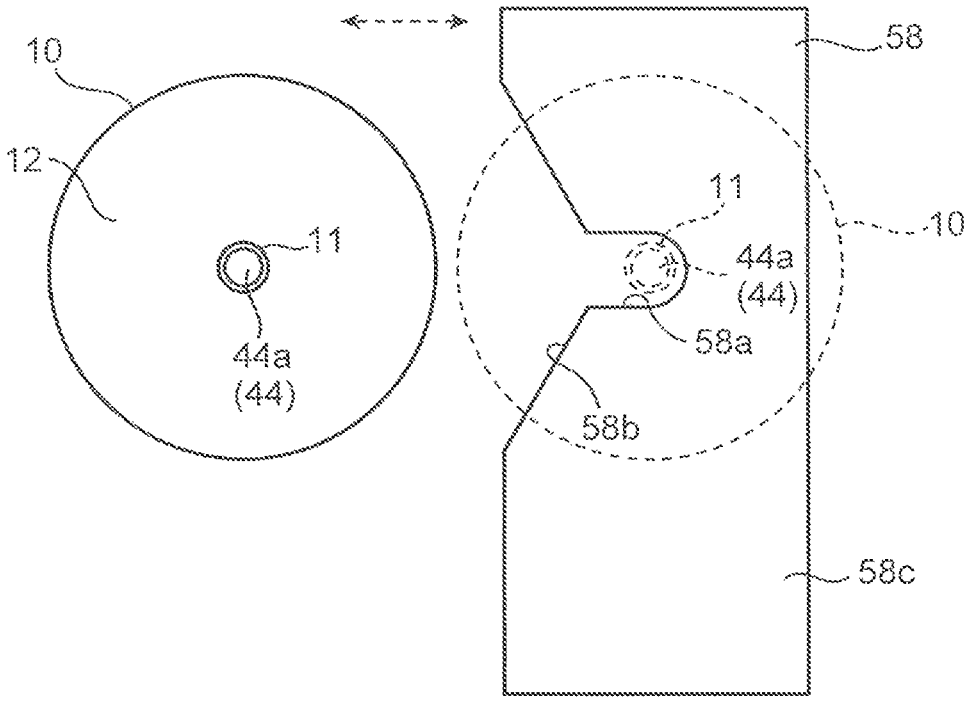
FIG. 14 is a plan view showing a mounting stand.

FIG. 14 is a schematic plan view showing the mounting stand 58. The mounting stand 58 is a plate-shaped member on which the roll 10 is mounted, and its upper surface is a mounting surface 58*c* extending horizontally on which the roll 10 can be mounted from above. As shown in FIG. 1, the mounting stand 58 is disposed at a position overlapping part of the light-shielding box 52 in plan view above the light-shielding box 52. In the present embodiment, the overall mounting stand 58 overlaps the upper wall 52*d* of the light-shielding box 52.

A groove section 58*a* is formed in the mounting stand 58. The groove 58*a* penetrates the mounting stand 58 in the vertical direction (first direction), and has an opening in the horizontal direction (second direction). In the example of the diagram, the groove section 58*a* has an opening on the rail 40 side (left side). Specifically, a notch 58*b* recessed rightward is formed in a generally central portion of the front and rear direction of the side surface on the rail 40 side of the mounting stand 58. The central portion of the front and rear direction of the notch 58*b* communicates with the groove section 58*a*.

An inside diameter of the groove section 58*a* (size of the front and rear direction) is set greater than an outside diameter of the transportation-side holder 44. Accordingly, the transportation-side holder 44 can enter the groove section 58*a* from the left side and down side of the mounting stand 58. The mounting stand 58 is supported by a lifting device 310 on the floor 90 in a vertically movable manner.

Figure 15:
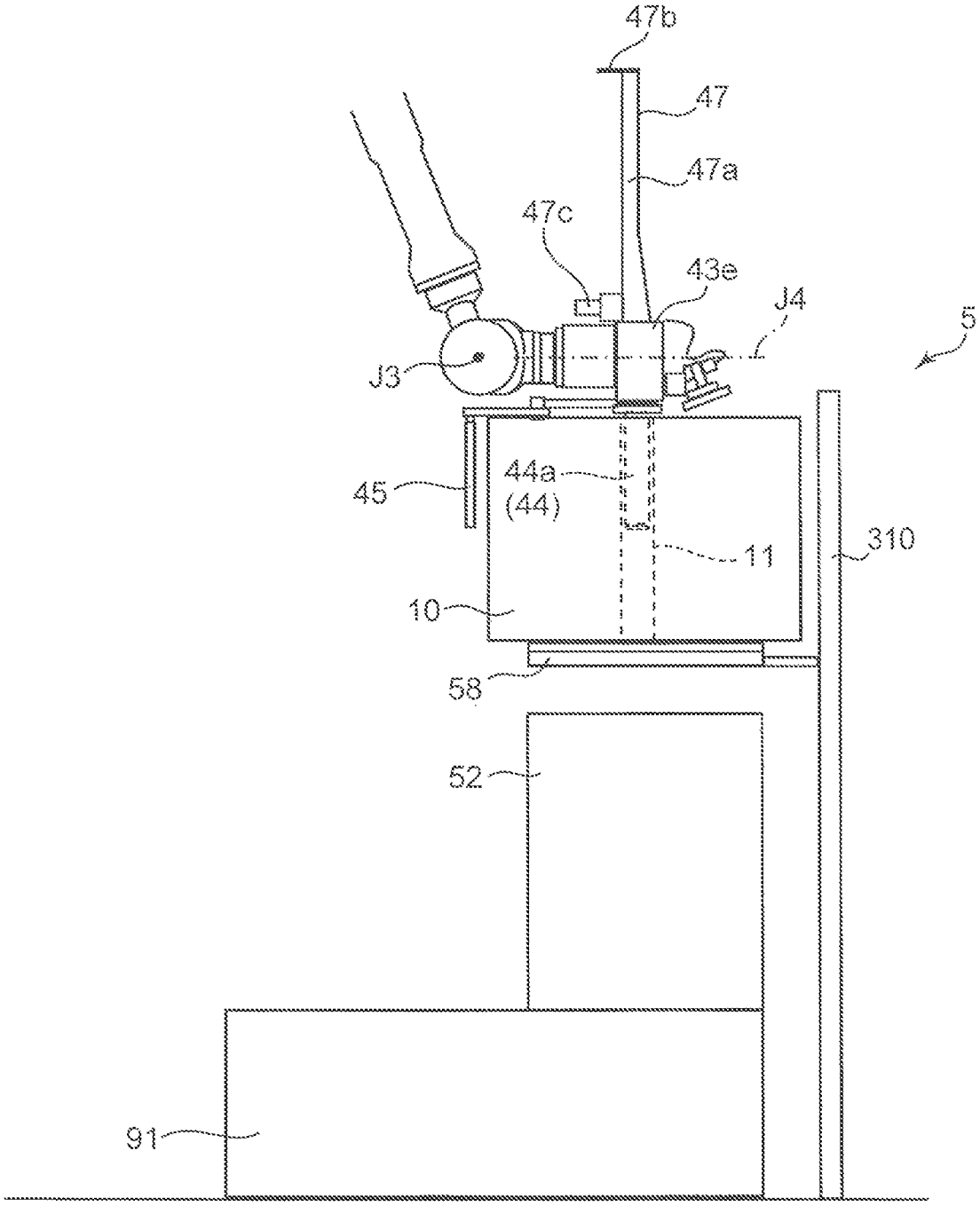
FIG. 15 is a schematic side view showing how the roll is mounted on the mounting stand.

The procedure for re-holding the roll 10 by using this mounting stand 58 will be described with reference to FIG. 14 to FIG. 16.

First, the roll 10 is lowered from above the mounting stand 58, and the roll 10 is mounted on the mounting surface 58*c*. Specifically, as shown in FIG. 15, the head 43*e* is disposed above the mounting stand 58, and the transportation-side holder 44 is lowered toward the mounting stand 58 in a posture extending downward from the head 43*e*. When the roll 10 is mounted on the mounting surface 58*c*, the press-contact sections 44*b* are returned to the waiting position, and the transportation-side holder 44 is moved upward. The roll 10 is left on the mounting surface 58*c* by the influence of gravity, and accordingly, the transportation-side holder 44 is pulled out from the roll 10.

Figure 16:
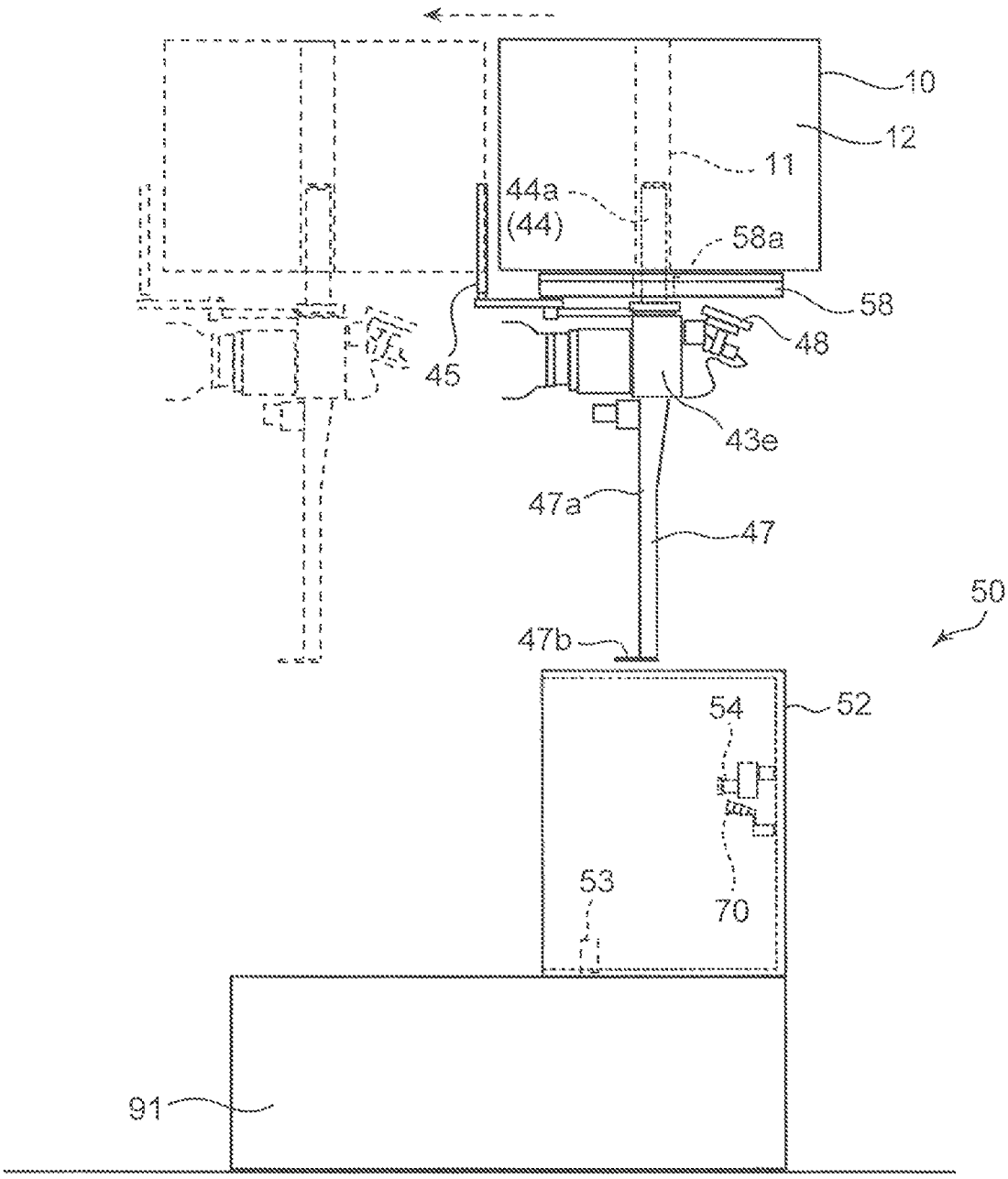
FIG. 16 is a schematic side view showing how the transportation-side holder re-holds the roll.

Next, as shown in FIG. 16, the mounting stand 58 on which the roll 10 is mounted is moved upward. Next, a posture is assumed in which the head 43*e* is disposed below the mounting stand 58, and the transportation-side holder 44 extends upward from the head 43*e*. Next, the head 43*e* goes up, and the transportation-side holder 44 is inserted into a predetermined position within the groove section 58*a* and the core member 11 of the roll 10 from below the mounting stand 58. Next, the press-contact sections 44*b* are moved to the press-contact position, press-contact the inner peripheral surface of the core member 11, and the transportation-side holder 44 holds the roll 10. Next, after the head 43*e* goes up slightly and raises the roll 10, as shown in a broken line of FIG. 16 and a solid line of FIG. 14, the transportation-side holder 44 moves leftward to the outside of the mounting stand 58 through the groove section 58*a* and the notch 58*b*.

(iv) Sheet Elimination Device

Figure 17:
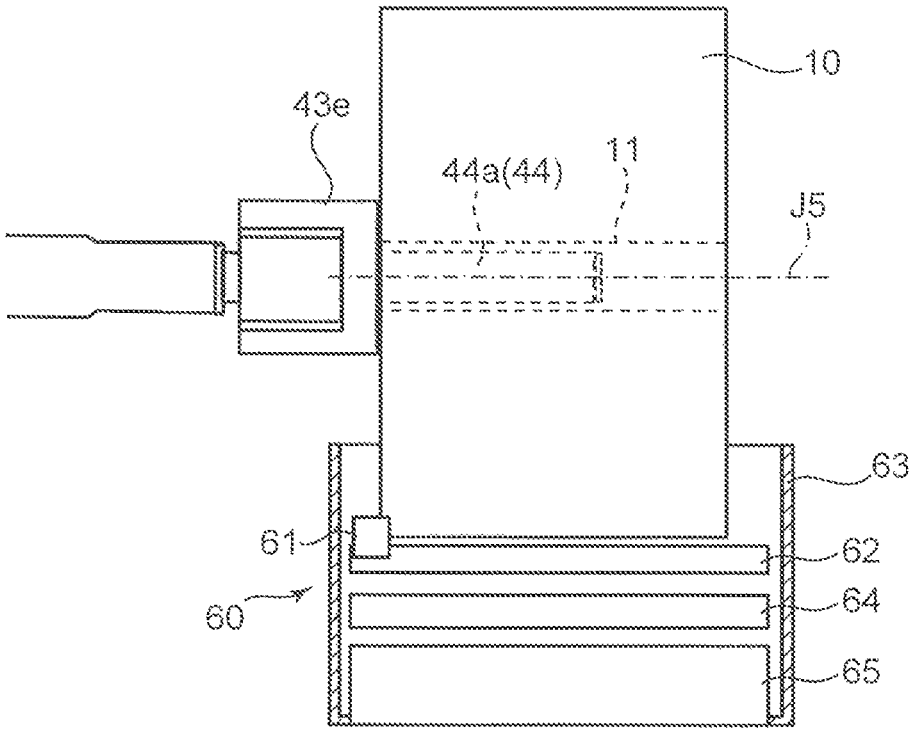
FIG. 17 is a cross-sectional view of the line XVII-XVII of FIG. 10.
Figure 18:
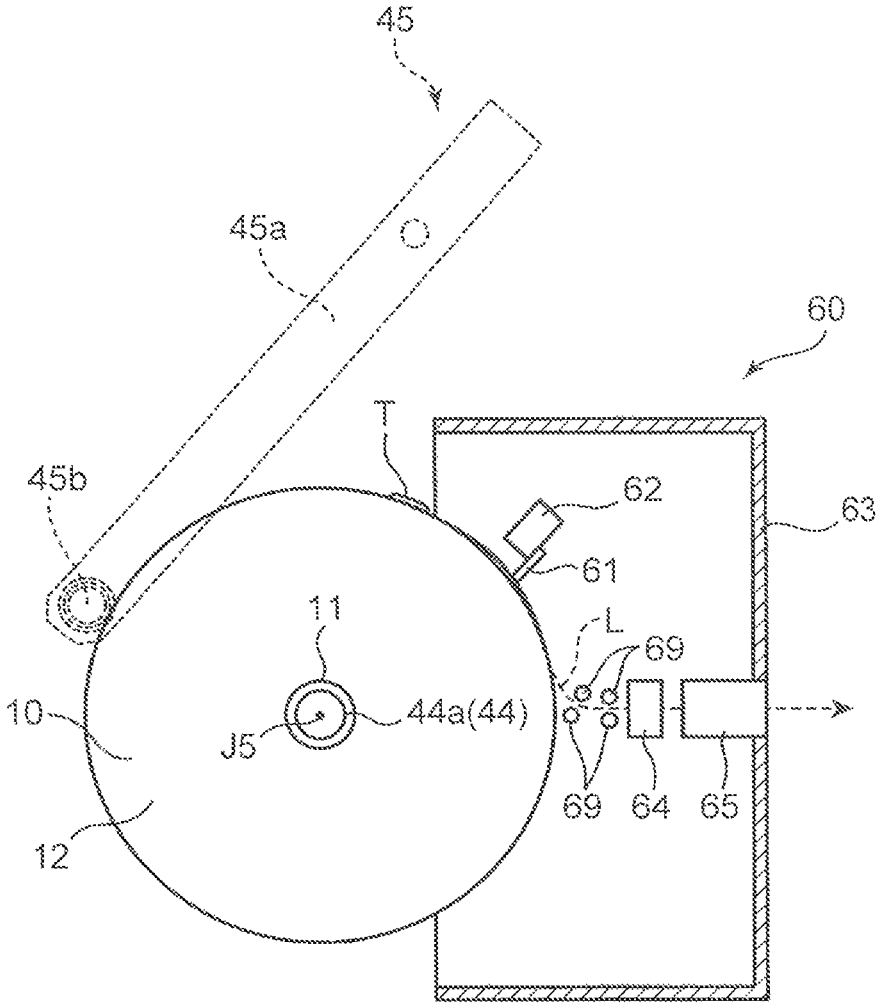
FIG. 18 is a cross-sectional view of the line XVIII-XVIII of FIG. 10.

FIG. 17 is a cross-sectional view of the line XVII-XVII of FIG. 10. FIG. 18 is a cross-sectional view of the line XVIII-XVIII of FIG. 10.

The sheet elimination device 60 is a device for eliminating the sheet 12 on the outermost peripheral surface of the roll 10. The sheet 12 positioned on the outermost periphery of the roll 10 may be dirty because of exposure to the outside. Therefore, the sheet elimination device 60 eliminates the sheet 12 of the outermost periphery. Also, in the present embodiment, the end of the sheet 12 positioned on the outermost peripheral surface of the roll 10 is fixed to the roll 10 by the tape T. The sheet elimination device 60 also eliminates the tape T by eliminating the sheet 12 of the outermost periphery.

The sheet elimination device 60 includes a first cutter (first cutting section) 61 for cutting the sheet 12, a cutter supporter 62 for slidably supporting the first cutter 61, a second cutter 64 (second cutting section) for cutting the sheet 12, a drawing device 65, a plurality of guide rolls 69, and a supporting wall 63 supporting these sections.

The sheet elimination device 60 is disposed such that the first cutter 61 can slide in the right and left direction. The first cutter 61 cuts the sheet 12 by sliding while in contact with the sheet 12. Meanwhile, the second cutter 64 includes cutting blades (not shown) sandwiching the sheet 12 vertically, and cuts the sheet 12 by compressing the sheet 12 between these cutting blades. The first cutter 61 and the second cutter 64 are driven by a cutter driving device 320 (refer to FIG. 19).

The drawing device 65 is a device for drawing the end of the sheet 12 formed by cutting the sheet 12 by the first cutter 61, and for disposing the sheet 12 along a drawing path L extending in a direction distant from the roll 10 in a radial direction of the roll 10. The drawing device 65 is connected to a suction device (not shown), draws the end of the sheet 12 by sucking the sheet 12, and disposes the sheet 12 to extend along the drawing path L.

Each guide roll 69 is for guiding the sheet 12 to the drawing device 65. The sheet 12 is introduced between the guide roll 69 positioned above and the guide roll 69 positioned below, and is guided to the drawing device 65.

In the present embodiment, the first cutter 61 cuts the sheet 12 while the roll 10 is supported by the transportation-side holder 44. Accordingly, the roll 10 is carried into the sheet elimination device 60 while being held by the transportation-side holder 44.

At this time, as shown in FIG. 17, the roll 10 is carried into the sheet elimination device 60 by the operation robot 41, in a posture in which the core member 11 extends along the right and left direction in which the first cutter 61 slides and moves. Also, at this time, the position of the transportation-side holder 44 is adjusted to allow the first cutter 61 to abut on the sheet 12 of the outermost periphery of the roll 10. Specifically, based on a touch sensor or the like (not shown) provided in the sheet elimination device 60, the position of the transportation-side holder 44 is adjusted at a position where the first cutter 61 can abut on the sheet 12.

After the transportation-side holder 44 is disposed in this way, the sheet 12 of the roll 10 is cut by the sheet elimination device 60 by the following procedure.

First, the first cutter 61 is driven to slide. Accordingly, the sheet 12 on the outermost peripheral surface of the roll 10 is cut at a predetermined position (first position) along the width direction. Note that the position of the circumferential direction of the roll at the predetermined position is adjusted by the transportation-side holder 44 rotating. Specifically, based on the position of the end of the sheet 12 detected by the winding direction detection device 51, the transportation-side holder 44 is rotated such that the end of the sheet 12 comes to the predetermined position with respect to the first cutter 61.

Next, the transportation-side holder 44 is driven to rotate, such that the end of the sheet 12 formed by being cut by the first cutter 61 (hereinafter appropriately referred to as cut end) comes to a position corresponding to the drawing device 65. Accordingly, the cut end of the sheet 12 is drawn into the drawing device 65, and the sheet 12 extends from the roll 10 along the drawing path L.

Subsequently, furthermore, the transportation-side holder 44 is driven to rotate in a direction to feed the sheet 12 (clockwise in FIG. 18 in the example of FIG. 18) such that the sheet 12 of a predetermined length from the cut end is drawn into the drawing device 65. Specifically, the transportation-side holder 44 is driven to rotate such that the sheet 12 is drawn into the drawing device 65 until the second cutter 64 faces a portion distant from the end of the sheet 12 on which the tape T is affixed by a peripheral length or more of the roll 10, the end being the original end of the sheet 12. In the present embodiment, the sheet 12 is fed such that the second cutter 64 faces a portion separated from the cut end, that is, the first position by the peripheral length or more of the roll 10.

Next, a portion of the sheet 12 facing the second cutter 64 is cut by the second cutter 64. At this time, the second cutter 64 faces a position of the sheet 12 separated from the first position (second position) by the peripheral length or more of the roll 10 as described above, and the sheet 12 is cut at this second position.

This cutting will cut a portion of the sheet 12 from the first position to the second position separated by the peripheral length or more of the roll 10, that is, a portion obtained by adding a portion of the sheet 12 from the original end to the first position to a portion from the first position to the second position. Accordingly, the original end of the sheet 12 is eliminated from the roll 10. Also, the sheet 12 positioned on the outermost peripheral surface of the roll 10 and having a stain or the like is eliminated.

The cut sheet 12 is sucked out to the predetermined scrapping place by the drawing device 65.

Subsequently, the transportation-side holder 44 is driven to rotate in the direction to take up the sheet 12. Accordingly, the new end of the sheet 12 formed by cutting at the second position is returned onto the peripheral surface of the roll 10.

Here, in the present embodiment, the roll radius detection sensor 70 detects the radius of the roll 10 as described above.

Therefore, as described above, after the sheet 12 is cut at the second position, when the end of the sheet 12 is returned to the roll 10, the rotation angle of the transportation-side holder 44 and the roll 10 is controlled by using this detected radius. Specifically, the rotation angle of the transportation-side holder 44 is calculated by using the distance from the second cutter 64 to the outermost peripheral surface of the roll 10 (for example, this is calculated by subtracting the radius of the roll 10 from the distance between the drawing device 65 and the central axis of the transportation-side holder 44) and the radius of the roll 10. In addition, the rotation angle of the transportation-side holder 44 necessary for moving the new end of the sheet 12 formed by the second cutter 64 to the outermost peripheral surface of the roll 10 is calculated. Then, the transportation-side holder 44 is rotated by this angle or more. Accordingly, the new end of the sheet 12 is more securely returned onto the outermost peripheral surface of the roll 10.

(v) Controller

FIG. 19 is a block diagram showing input and output of the controller 100. Signals from devices such as the head-side camera 48, the winding direction detection camera 54, and the roll radius detection sensor 70 are input into the controller 100. Based on these input signals, the controller 100 controls the transportation device 4, the light 53, the lifting device 310, and the cutter driving device 320. In particular, the controller 100 controls the running motor 201, the arm driving motors 202, the press-contact section driving device 301, the hand section rotating motor 302, the pressure section driving device 303, and the pusher driving device 304 provided in the operation robot 4, thereby controlling the operation robot 41.

Figure 20:
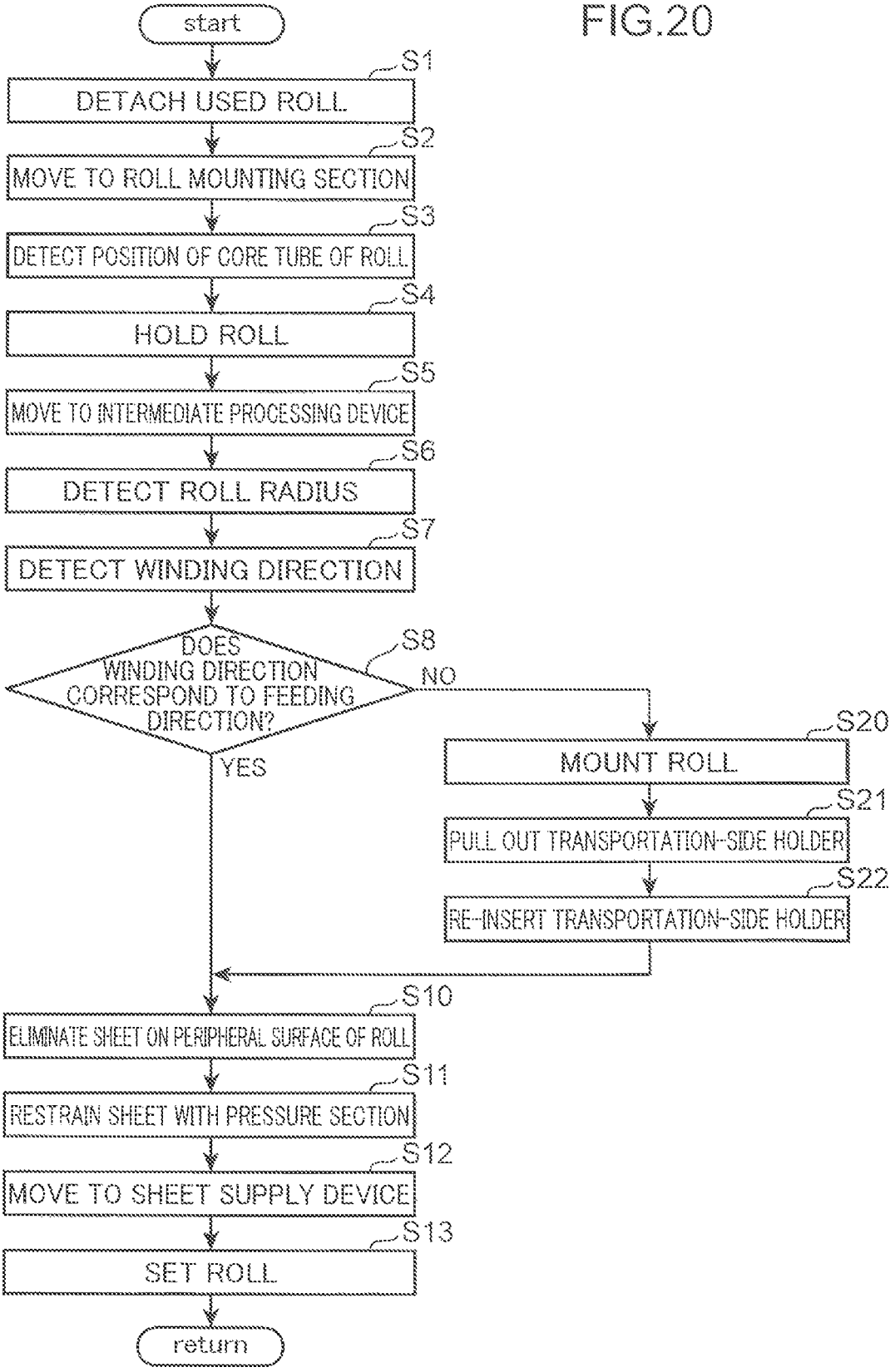
FIG. 20 is a flowchart showing an overall flow of processing to be performed by the sheet supply system.

Overall processing to be performed by the controller 100 will be described with reference to a flowchart of FIG. 20.

First, in step S1, the controller 100 controls the running motor 201 and the arm driving motors 202 to cause the operation robot 41 to detach the used roll 10 from the supporting shaft 22.

Specifically, the controller 100 causes the sheet supply device 2 to move the operation robot 41. Next, as described above, the controller 100 places the core member detachment section 47 below the supporting shaft 22, and then raises the core member detachment section 47, and subsequently, moves the core member detachment section 47 in a direction separated from the supporting wall 21*a*. Accordingly, the controller 100 causes the claw 47*b* to abut on the end of the core member 11 of the used roll 10. Next, the controller 100 causes the core member detachment section 47 to separate from the supporting wall 21*a*, and causes the core member detachment section 47 to pull out part of the used roll 10 from the supporting shaft 22. Subsequently, the controller 100 causes the clamping sections 47*c* to grasp the used roll 10, and causes the core member detachment section 47 to pull out the roll 10 from the supporting shaft 22. Then, the controller 100 causes the core member detachment section 47 to scrap the used roll 10 in the scrapping place.

Next, in step S2, the controller 100 moves the operation robot 41 to the roll mounting section 3 (movement step).

Specifically, the controller 100 controls the running motor 201 to move the operation robot 41 to a position facing the roll mounting section 3.

Next, in step S3, the controller 100 detects the position of the core member 11 of the roll 10. Specifically, as described above, the controller 100 causes the head-side camera 48 to capture an image of the roll 10 mounted on the roll mounting section 3. Also, the controller 100 detects the central position of the core member 11 of the roll 10 based on the captured image. As described above, in the present embodiment, first, after the overall image of the rolls 10 mounted on the roll mounting section 3 is captured, the high-priority roll 10 to be conveyed next is specified, and subsequently, the central position of the core member 11 of this roll 10 is detected. Furthermore, the controller 100 detects the schematic size of the outside diameter of the roll 10, and confirms that the target roll 10 has the prescribed size.

Next, in step S4, the controller 100 controls the arm driving motors 202 and the press-contact section driving device 301 to cause the transportation-side holder 44 of the operation robot 41 to hold the roll 10 (roll acquisition step).

Specifically, as described above, the controller 100 causes the transportation-side holder 44 to enter the core member 11 of the roll 10 from above, and moves the press-contact sections 44*b* to the press-contact position to press-contact the inner peripheral surface of the core member 11, thereby causing the transportation-side holder 44 to hold the roll 10. At this time, as described above, the controller 100 causes the transportation-side holder 44 to enter the core member 11 while adjusting the position of the transportation-side holder 44 based on the image captured by the head-side camera 48. When the roll 10 is held by the transportation-side holder 44 in this way, the controller 100 controls the arm driving motors 202 to promptly change the posture of the transportation-side holder 44 such that the central axis J5 becomes horizontal. In this way, even if some trouble arises in the press-contact section driving device 301 and press-contact force of the press-contact sections 44*b* disappears, it is possible to prevent the roll 10 from falling out easily from the transportation-side holder 44.

Next, in step S5, the controller 100 controls the running motor 201 to move the operation robot 41 to the intermediate processing device 5.

Next, in step S6, the controller 100 controls the arm driving motors 202 and the hand section rotating motor 302 to detect the radius of the roll 10 (intermediate processing step).

Specifically, the controller 100 controls the arm driving motors 202 to dispose the transportation-side holder 44 such that as described above, the transportation-side holder 44 extends in the front and rear direction, and the distance between the central axis J5 of the transportation-side holder 44 and the roll radius detection sensor 70 becomes the reference distance. Then, the controller 100 detects the radius of the roll 10 based on the distance between the roll radius detection sensor 70 and the peripheral surface of the roll 10 detected by the roll radius detection sensor 70. Also, at this time, the controller 100 controls the hand section rotating motor 302 to rotate the transportation-side holder 44 and detect the radii at a plurality of positions of the circumferential direction of the roll 10, and averages the radii to calculate the radius of the roll 10.

Next, in step S7, the controller 100 detects the winding direction of the roll 10 (winding direction detection step, intermediate processing step).

Specifically, the controller 100 controls the arm driving motors 202 to cause the transportation-side holder 44 to have a posture in which the central axis J5 extends in the front and rear direction. Also, the controller 100 inserts the roll 10 into the light-shielding box 52 from the opening 52*f*, and disposes part of the peripheral surface of the roll 10 within the light-shielding box 52. Next, the controller 100 controls the light 53 and the hand section rotating motor 302 to illuminate the peripheral surface of the roll 10 with the light 53 while rotating the transportation-side holder 44 about its central axis J5, and causes the winding direction detection camera 54 to capture an image of the peripheral surface of the roll 10. Then, the controller 100 detects the winding direction of the roll 10 based on the captured image. Furthermore, based on the captured image, the controller 100 also detects the position of the end of the sheet 12 on the outermost peripheral surface of the roll 10.

Next, in step S8, the controller 100 determines whether the detected winding direction is a direction corresponding to the feeding direction of the supporting shaft 22 to which the roll 10 held by the transportation-side holder 44 is expected to be conveyed.

When the determination of step S8 is NO and the detected winding direction is not the feeding direction, the process proceeds to step S20. In steps S20 to S21, the controller 100 controls the arm driving motors 202 and the press-contact section driving device 301 to perform a roll re-holding step of causing the operation robot 41 to re-hold the roll 10 (intermediate processing step).

Specifically, in step S20, the controller 100 performs a roll mounting step of mounting the roll 10 on the mounting surface 58*c* of the mounting stand 58.

Next, in step S21, the controller 100 performs a pulling-out step of pulling out the transportation-side holder 44 from the roll 10.

Next, in step S22, the controller 100 performs a roll re-holding step of raising the mounting stand 58, inserting the transportation-side holder 44 again from below into the groove section 58*a* of the mounting stand 58 to hold the roll 10. Then, the controller 100 moves the transportation-side holder 44 to the outside of the mounting stand 58 through the notch 58*b*. Note that when this re-holding process is finished, the controller 100 lowers the mounting stand 58.

After step S20, the process proceeds to step S10.

On the other hand, when the determination of step S8 is YES and the detected winding direction is a direction corresponding to the feeding direction of the supporting shaft 22, the process proceeds to step S10. That is, in the present embodiment, when the winding direction of the roll 10 held by the transportation-side holder 44 is a direction corresponding to the feeding direction, the process proceeds to step S10, without performing steps S20 to S22 (without mounting the roll 10 on the mounting stand 58).

In step S10, the controller 100 controls the running motor 201 and the like to move the roll 10 to the sheet elimination device 60.

Also, in step S10, the controller 100 controls the arm driving motors 202 and the cutter driving device 320 to eliminate the sheet 12 on the outermost peripheral surface of the roll 10 (sheet elimination step, intermediate processing step).

Specifically, as described above, the controller 100 disposes the roll 10 at a position where the first cutter 61 can abut on the sheet 12 on the peripheral surface of the roll 10. The controller 100 causes the first cutter 61 to cut the sheet 12 on the outermost peripheral surface of the roll 10 at the predetermined position (first position). Subsequently, the controller 100 rotates the transportation-side holder 44 and the roll 10 to feed the sheet 12 on the upstream side of the feeding direction from the first position where first cut is performed from the roll 10 along the drawing path L, and causes the sheet 12 to be drawn into the drawing device 65. Next, the controller 100 causes the second cutter 64 to cut the sheet 12 at the position distant from the first position by one peripheral length or more of the roll 10 (second position). Subsequently, the controller 100 rewinds the fed sheet 12, and disposes the new end formed at the second position at a predetermined position on the outermost peripheral surface of the roll 10.

Next, in step S11, the controller 100 controls the pressure section driving device 303 to cause the pressure section 45 to restrain, on the roll 10, the end of the sheet 12 on the peripheral surface of the roll 10 (new end formed in step 10) or its neighborhood. Specifically, after the sheet 12 is cut in step S10, when the roll 10 moves to the outside of the supporting wall 63, the controller 100 drives the pressure section 45 immediately. Then, as described above, the controller 100 causes the pressure section body 45*b* to abut on the roll 10 from the outside of the radial direction of the roll 10, presses the end of the sheet 12 on the peripheral surface of the roll 10 or its neighborhood on the roll 10, and restrains the end or its neighborhood on the peripheral surface of the roll 10.

Next, in step S12, the controller 100 controls the running motor 201 and the like to move the roll 10 to the sheet supply device 2.

Subsequently, in step S13, the controller 100 controls the arm driving motors 202, the press-contact section driving device 301, the pressure section driving device 303, and the pusher driving device 304 to set the roll 10 held by the transportation-side holder 44 in the supporting shaft 22 (setting step).

Specifically, as described above, the controller 100 disposes the transportation-side holder 44 to face the supporting shaft 22. The controller 100 inserts the tip of the supporting shaft 22 into a portion of the core member 11 of the roll 10 protruding from the tip of the transportation-side holder 44. Then, after setting the press-contact sections 44*b* at the waiting position and separating the pressure section body 45*b* from the peripheral surface of the roll 10, the controller 100 pushes out the roll 10 from the transportation-side holder 44 to the supporting shaft 22 side with the pusher 46. Accordingly, the supporting shaft 22 is inserted into the core member 11 of the roll 10, and the roll 10 is set at the predetermined position of the supporting shaft 22.

(3) EFFECTS AND THE LIKE

As described above, in the sheet supply system 1 including the roll conveyance device 200 according to the present embodiment, all of the roll mounting section 3 on which the roll 10 is mounted, the intermediate processing device 5 including the mounting stand 58 and performing various processes on the roll 10, and the sheet supply device 2 that feeds the sheet 12 continuously are disposed in a moving range of the transportation-side holder 44. Then, the controller 100 controls the operation robot 41 such that after the transportation-side holder 44 holds the roll 10 on the roll mounting section 3, the roll 10 moves to the sheet supply device 2 through the intermediate processing device 5.

Therefore, the roll 10 mounted on the roll mounting section 3 can be automatically supplied to the sheet supply device 2. Also, the intermediate processing device 5 can perform each intermediate processing on the roll 10. Therefore, a worker does not need to perform work for conveying the roll 10 mounted on the roll mounting section 3 to the sheet supply device 2 and setting the roll 10 in the supporting shaft 22, and the intermediate processing. This will enhance work efficiency. Also, the roll 10 that has undergone the intermediate processing and is in an appropriate state can be set in the sheet supply device 2.

Furthermore, the overall configuration of the device can be simplified. That is, in this sheet supply system 1, all the rolls 10 mounted on the roll mounting section 3 are conveyed to the supporting shafts 22 through the intermediate processing device 5, regardless of which supporting shaft 22 each roll 10 is conveyed to. Therefore, it is not necessary to individually provide a device for performing the intermediate processing on the roll 10 for each supporting shaft 22. Therefore, the intermediate processing device 5 can be used in common to the plurality of rolls 10. This will simplify the device.

In particular, this system 1 makes it possible that the roll re-holding step is performed during conveyance of the roll 10 and that the transportation-side holder 44 re-holds the roll 10 during conveyance of the roll 10. Therefore, the roll 10 can be supplied to the sheet supply device 2 in a state where the winding direction is an appropriate direction. This makes it unnecessary to change the posture of the roll 10 such that the winding direction of the roll 10 becomes an appropriate direction on the roll mounting section 3. Also, a worker does not need to change the posture of the roll 10 to the posture suitable for the sheet supply device 2 every time the roll 10 is delivered to the supporting shaft 22. Therefore, this makes it possible to omit work for adjusting or changing the posture of the roll 10, further enhancing work efficiency.

Also, the embodiment can implement re-holding of the roll 10 with the simple configuration of forming the groove section 58*a* configured as described above in the mounting stand 58.

Also, in the embodiment, the roll 10 is mounted on the mounting surface 58*c* of the mounting stand 58 in the posture in which the axis of the roll 10 extends in the vertical direction. Therefore, it is possible to inhibit deformation of the peripheral surface of the roll 10 better than when the roll 10 is mounted on the mounting stand 58 in the posture in which the axis of the roll 10 extends in the horizontal direction or the like and the peripheral surface of the roll abuts on the mounting stand 58. In particular, in this embodiment, a relatively soft material such as a nonwoven fabric and a tissue is used as the sheet of the roll 10, and the roll 10 is deformed easily. Therefore, the configuration of the embodiment described above can inhibit deformation of the roll 10 effectively.

Also, the sheet supply system 1 includes the winding direction detection device 51 to detect the winding direction of the roll 10 held by the transportation-side holder 44, and to allow the roll 10 to be mounted on the mounting stand 58 only when the winding direction is not the direction corresponding to the feeding direction.

Therefore, the roll 10 can be supplied to the sheet supply device 2 in a state where the winding direction of the roll 10 is set at an appropriate direction more certainly.

Furthermore, the winding direction of the roll is detected in a state where the roll 10 is held by the transportation-side holder 44. Therefore, it is not necessary to provide a separate device for holding the roll 10 when detecting the winding direction of the roll 10, simplifying the device. In addition, it is possible to convey the roll efficiently by omitting delivery of the roll between this device for holding the roll and the transportation-side holder 44.

In addition, in the roll conveyance device 200, the mounting stand 58 is disposed above the winding direction detection device 51. Therefore, a horizontal size of the overall device can be kept small. Also, a horizontal movement distance of the transportation-side holder4 44 can also be kept small.

Also, in this sheet supply system 1, the operation robot 41 can move on the rail 40. This makes it possible to increase the moving range of the transportation-side holder 44 and to convey the roll 10 in a wider range, without enlarging the operation robot 41.

Also, this sheet supply system 1 causes the transportation-side holder 44 to hold the roll 10 by inserting the transportation-side holder 44 into the core member 11. Therefore, compared with a case where the roll 10 is held by grasping the peripheral surface of the roll 10 or the like, the roll 10 can be held in a state where deformation of the roll 10 is inhibited. In particular, a sheet of a relatively soft material, such as a nonwoven fabric and a tissue, is used for a disposable diaper, as described above. Therefore, if the peripheral surface of the roll formed of this sheet is grasped, the roll 10 will be deformed. In contrast, the present embodiment causes the transportation-side holder 44 to hold the roll 10 by inserting the transportation-side holder 44 into the core member 11, making it possible to convey the roll 10 while inhibiting deformation of the roll 10.

(4) MODIFICATION

The embodiment has described a case of including the winding direction detection device 51. However, the winding direction detection device 51 can be omitted when it is apparent that the winding direction of the roll 10 obtained by the transportation-side holder 44 on the roll mounting section 3 (the winding direction of the roll 10 in a state of being held by the transportation-side holder 44) agrees with the direction corresponding to the winding direction of the roll 10 in the sheet supply device 2. For example, when all the rolls 10 are aligned in the same winding direction on the roll mounting section 3, the winding direction of the roll 10 in a state of being held by the transportation-side holder 44 is fixed. Therefore, even if the winding directions of the rolls 10 set in a pair of supporters 22 differ from each other, it is possible to easily determine whether the winding direction of the roll 10 corresponds to the winding direction of the roll 10 in the supporter 22 to which the roll 10 is to be conveyed, by this supporter 22 being specified. Therefore, in this case, the embodiment is not required to include the winding direction detection device 51.

The embodiment has described a case where the operation robot 41 moved on the rail 40, but the rail 40 may be omitted.

Also, the embodiment has described a case where the end of the sheet 12 positioned on the outermost peripheral surface of the roll 10 is irradiated with light, and the winding direction of the roll 10 is detected with the direction of the shadow that arises in the surroundings or the reflected light. However, specific procedures for detecting the winding direction of the roll 10 are not limited to this procedure.

Also, the embodiment has described a case where the roll 10 is mounted on the mounting stand 58 in a posture in which the axis of the roll 10 extends in the vertical direction. However, the posture when the roll 10 is mounted on the mounting stand 58 is not limited to this posture. For example, the roll 10 may be mounted on the mounting stand 58 in a posture in which the axis extends in the horizontal direction. In this case, furthermore, the mounting stand 58 may be rotated about an axis extending in the vertical direction. In this way, after the transportation-side holder 44 is pulled out from a first side of the axial direction of the core member 11 of the roll 10, by rotating the mounting stand 58, the transportation-side holder 44 can be inserted into the core member 11 of the roll 10 from a second side of the axial direction, without moving the transportation-side holder 44 to the second side of the axial direction of the roll 10, and the moving range of the transportation-side holder 44 can be kept small.

Note that the above-described specific embodiment mainly includes the invention having the following configurations.

That is, the present invention provides a roll conveyance device for conveying a roll including a tubular core member and a sheet wound around a periphery of the core member from a mounting position set in advance to a target position. The roll conveyance device includes: a transportation device including: a body; an arm including a proximal section connected to the body and a distal section that is relatively displaceable with respect to the proximal section; and a roll holding shaft, the roll holding shaft holding the roll in a state of extending in a predetermined direction from the distal section of the arm and being inserted into the core member of the roll; a controller configured to control the transportation device in such a manner that the roll holding shaft moves from the mounting position to the target position; and a re-hold mounting section disposed within a moving range of the roll holding shaft, the re-hold mounting section having a shape that allows the roll to be mounted in a state where both ends of an axial direction of the core member of the roll are open in order to change an insertion direction of the roll holding shaft into the core member of the roll. The controller controls the transportation device in such a manner that the roll with the roll holding shaft inserted is mounted on the re-hold mounting section, the roll holding shaft is pulled out from the core member of the roll mounted on the re-hold mounting section to one side of the axial direction of the core member, and the roll holding shaft pulled out from the core member is inserted into the core member of the roll from the other side of the axial direction of the core member to hold the roll.

According to this invention, since the transportation device automatically conveys the roll from the mounting position to the target position, work efficiency can be enhanced. Moreover, the roll mounting section configured as described above is provided within the moving range of the roll holding shaft. Therefore, with the simple configuration of mounting the roll on the re-hold mounting section and changing the insertion direction of the transportation-side holder into the mounted roll, the insertion direction of the roll holding shaft into the core member can be changed during conveyance of the roll. Therefore, when the roll needs to be conveyed to the sheet supply device in a state where the winding direction of the roll is a predetermined direction (for example, when the winding direction of the roll is determined in order that the sheet supply device feeds the sheet appropriately), the roll can be supplied to the sheet supply device in a state where the winding direction is an appropriate direction. Also, on the roll mounting section or the like, it is possible to allow a worker to omit work for disposing the roll in advance such that the winding direction corresponds to the predetermined direction, and work for changing the direction of the roll to a direction suitable for the sheet supply device every time the roll is conveyed to the sheet supply device. This will further enhance work efficiency.

In the configuration described above, preferably, the re-hold mounting section includes a groove section, the groove section penetrating the re-hold mounting section and has a shape open in a second direction orthogonal to a first direction to allow the roll holding shaft to be inserted along the first direction and to allow the roll holding shaft to move along the second direction, and the controller controls the transportation device in such a manner that the roll is mounted on the re-hold mounting section at a position at which an inside portion of the core member overlaps with the groove section when viewed along the first direction, the roll holding shaft is pulled out from the core member of the roll to one side of the first direction, the roll holding shaft is inserted into the core member of the roll from the other side of the first direction, and then the roll holding shaft is moved in the second direction.

With this configuration, with the simple configuration of providing the groove section that allows movement of the roll holding shaft in the re-hold mounting section, the insertion direction of the roll holding shaft into the core member can be changed.

In the configuration described above, preferably, the re-hold mounting section includes a mounting surface, the core member of the roll being mounted on the mounting surface in a posture of extending in the first direction, and the first direction is set as a vertical direction, and the second direction is set as a horizontal direction.

With this configuration, the roll can be mounted on the mounting surface of the re-hold mounting section in the posture in which the axis of the roll extends in the vertical direction, and the insertion direction of the transportation-side holder can be changed in this posture. Therefore, this can inhibit deformation of the peripheral surface of the roll.

In the configuration described above, preferably, the roll conveyance device further includes a winding direction detection device disposed within the moving range of the roll holding shaft, the winding direction detection device configured to detect a winding direction of the roll, and the controller controls the transportation device in such a manner that the roll is mounted on the re-hold mounting section only when the winding direction of the roll detected by the winding direction detection device is not a direction set corresponding to the roll to be used at the target position.

With this configuration, for example, even in a case where the winding direction of the roll at the mounting position is random or the roll having the winding direction with the target position different from each other is used, the roll can be delivered to the sheet supply device in a state where the winding direction of the roll becomes the appropriate direction set in advance more securely.

In the configuration described above, preferably, the mounting section is disposed above the winding direction detection device.

In this way, a horizontal size of the overall device can be kept small. Also, a horizontal movement distance of the transportation device can also be kept small.

In the configuration described above, preferably, the winding direction detection device detects the winding direction of the roll in a state where the roll holding shaft holds the roll.

With this configuration, it is not necessary to provide a separate device for holding the roll when detecting the winding direction of the roll. This will simplify the device. Also, delivery of the roll between this device for holding the roll and the roll holding shaft can be omitted. This implements efficient conveyance of the roll.

Also, the present invention provides a roll conveyance method for conveying a roll including a tubular core member and a sheet wound around a periphery of the core member from a mounting position set in advance to a target position, by using: a transportation device including: a body; an arm including a proximal section connected to the body and a distal section that is relatively displaceable with respect to the proximal section; and a roll holding shaft, the roll holding shaft holding the roll in a state of extending in a predetermined direction from the distal section of the arm and being inserted into the core member of the roll; and a re-hold mounting section having a shape that allows the roll to be mounted in a state where both ends of an axial direction of the core member of the roll are open in order to change an insertion direction of the roll holding shaft into the core member of the roll. The roll conveyance method includes a roll re-holding step to be performed while conveying the roll from the mounting position to the target position. The roll re-holding step includes: a roll mounting step of mounting the roll on the re-hold mounting section; a pull out step of pulling out the roll holding shaft from the core member of the roll mounted on the re-hold mounting section to one side of the axial direction of the core member; and a re-roll holding step of inserting the roll holding shaft pulled out from the core member into the core member of the roll from the other side of the axial direction of the core member to cause the roll holding shaft to hold the roll.

By this method, the roll can be automatically conveyed from the mounting position to the target position by using the transportation device, enhancing work efficiency. Moreover, by a simple procedure for mounting the roll on the re-hold mounting section and changing the insertion direction of the transportation-side holder into the mounted roll, the insertion direction of the roll holding shaft into the core member can be changed during conveyance of the roll. Therefore, even when the roll needs to be conveyed to the sheet supply device in a state where the winding direction of the roll is the predetermined direction (for example, when the winding direction of the roll mounted on the mounting section is random while the winding direction of the roll is determined in order to feed the sheet appropriately in the sheet supply device, or when the pair of roll supporters of the sheet supply device supports the rolls having the winding directions different from each other), the roll can be supplied to the sheet supply device in a state where the winding direction is appropriate. Also, on the roll mounting section or the like, it is possible to allow a worker to omit work for disposing the roll in advance such that the winding direction corresponds to the predetermined direction, and work for changing the direction of the roll to a direction suitable for the sheet supply device every time the roll is conveyed to the sheet supply device. This will further enhance work efficiency.

In the configuration described above, preferably, the roll conveyance method further includes a winding direction detection step to be performed before the roll re-holding step, the winding direction detection step detecting a winding direction of the roll held by the roll holding shaft, and the roll re-holding step is performed only when the winding direction of the roll detected in the winding direction detection step is not a direction set corresponding to the roll to be used at the target position.

With this configuration, the roll can be conveyed to the target position in a state where the winding direction of the roll becomes an appropriate direction more securely.

The invention claimed is:

1. A roll conveyance device for conveying a roll including a tubular core member and a sheet wound around a periphery of the core member from a mounting position set in advance to a target position, the roll conveyance device comprising:

a transportation device including:

a body;

an arm including a proximal section connected to the body and a distal section that is relatively displaceable with respect to the proximal section; and a roll holding shaft configured to hold the roll while extending in a predetermined direction from the distal section of the arm and while being inserted into the core member of the roll;

a controller configured to control the transportation device to cause the roll holding shaft to move from the mounting position to the target position; and a re-hold mounting section within a moving range of the roll holding shaft, the re-hold mounting section having a shape to allow the roll to be mounted in a state in which both axial ends of the core member of the roll are open to allow a change in an insertion direction of the roll holding shaft into the core member of the roll, wherein the controller is further configured to control the transportation device to cause the roll with the roll holding shaft inserted therein to be mounted on the re-hold mounting section, the roll holding shaft being further configured to be pulled out from the core member of the roll mounted on the re-hold mounting section to a first side in an axial direction of the core member, and to be pulled out from the core member to be inserted into the core member of the roll from a second side in the axial direction of the core member to hold the roll.

2. The roll conveyance device according to claim 1, wherein the re-hold mounting section includes a groove section penetrating the re-hold mounting section and having a shape open in a second direction orthogonal to a first direction to allow the roll holding shaft to be inserted along the first direction and to allow the roll holding shaft to move along the second direction, and wherein the controller is configured to control the transportation device to cause the roll to be mounted on the re-hold mounting section at a position at which an inside portion of the core member overlaps with the groove section when viewed along the first direction to cause the roll holding shaft to be pulled out from the core member of the roll to a first side with respect to the first direction, to cause the roll holding shaft to be inserted into the core member of the roll from a second side with respect to the first direction, and to cause the roll holding shaft to be moved in the second direction.

3. The roll conveyance device according to claim 2, wherein the re-hold mounting section includes a mounting surface, the core member of the roll being mounted on the mounting surface so as to extend in the first direction, and the first direction is set as a vertical direction, and the second direction is set as a horizontal direction.

4. The roll conveyance device according to claim 1, further comprising a winding direction detection device within the moving range of the roll holding shaft, the winding direction detection device being configured to detect a winding direction of the roll, wherein the controller is further configured to control the transportation device to cause the roll to be mounted on the re-hold mounting section only when the winding direction of the roll detected by the winding direction detection device is not a direction set corresponding to the roll to be used at the target position.

5. The roll conveyance device according to claim 4, wherein the mounting section is above the winding direction detection device.

6. The roll conveyance device according to claim 4, wherein the winding direction detection device is configured to detect the winding direction of the roll in a state where the roll holding shaft holds the roll.

7. A roll conveyance method of conveying a roll including a tubular core member and a sheet wound around a periphery of the core member from a mounting position set in advance to a target position, the method comprising using:

a transportation device including:

a body;

an arm including a proximal section connected to the body and a distal section that is relatively displaceable with respect to the proximal section; and a roll holding shaft configured to hold the roll while extending in a predetermined direction from the distal section of the arm and while being inserted into the core member of the roll; and a re-hold mounting section having a shape to allow the roll to be mounted in a state in which both axial ends of the core member of the roll are open to allow a change in an insertion direction of the roll holding shaft into the core member of the roll, the roll conveyance method comprising a roll re-holding step to be performed while conveying the roll from the mounting position to the target position, the roll re-holding step including:

a roll mounting step of mounting the roll on the re-hold mounting section;

a pull out step of pulling out the roll holding shaft from the core member of the roll mounted on the re-hold mounting section to a first side in an axial direction of the core member; and a re-roll holding step of inserting the roll holding shaft pulled out from the core member into the core member of the roll from a second side of the axial direction of the core member to cause the roll holding shaft to hold the roll.

8. The roll conveyance method according to claim 7, further comprising a winding direction detection step to be performed before the roll re-holding step, the winding direction detection step comprising detecting a winding direction of the roll held by the roll holding shaft, wherein the roll re-holding step is performed only when the winding direction of the roll detected in the winding direction detection step is not a direction set corresponding to the roll to be used at the target position.

* * * * *